US011207585B2

(12) United States Patent
Awakuni

(10) Patent No.: US 11,207,585 B2
(45) Date of Patent: Dec. 28, 2021

(54) PLATE FOR SNOWBOARD BINDING

(71) Applicant: JP TIGHT CO., LTD., Kawasaki (JP)

(72) Inventor: Tomotsugu Awakuni, Kawasaki (JP)

(73) Assignee: JP TIGHT CO., LTD., Kawasaki (JP)

( * ) Notice: Subject to any disclaimer, the term of this patent is extended or adjusted under 35 U.S.C. 154(b) by 239 days.

(21) Appl. No.: 16/489,406

(22) PCT Filed: Feb. 2, 2018

(86) PCT No.: PCT/JP2018/003555
§ 371 (c)(1),
(2) Date: Aug. 28, 2019

(87) PCT Pub. No.: WO2018/189984
PCT Pub. Date: Oct. 18, 2018

(65) Prior Publication Data

US 2019/0388771 A1 Dec. 26, 2019

(30) Foreign Application Priority Data

Apr. 11, 2017 (JP) ..... JP2017-077947

(51) Int. Cl.
*A63C 10/14* (2012.01)
*A63C 10/16* (2012.01)

(52) U.S. Cl.
CPC ..... *A63C 10/14* (2013.01); *A63C 10/16* (2013.01)

(58) Field of Classification Search
CPC ..... A63C 10/14; A63C 10/145; A63C 10/18
USPC ..... 280/14.24
See application file for complete search history.

(56) References Cited

U.S. PATENT DOCUMENTS 5,236,216 A * 8/1993 Ratzek ..... A63C 10/18 280/14.21
5,261,689 A * 11/1993 Carpenter ..... A63C 10/24 280/618
5,762,358 A * 6/1998 Hale ..... A63C 10/18 280/607
5,782,476 A * 7/1998 Fardie ..... A63C 10/18 280/14.24
5,803,481 A * 9/1998 Eaton ..... A63C 10/18 280/14.24
5,820,155 A * 10/1998 Brisco ..... A63C 10/145 280/607

(Continued)

FOREIGN PATENT DOCUMENTS

JP 2001-506531 A 5/2001
JP 2007-143727 A 6/2007

OTHER PUBLICATIONS

English Translation of International Search Report of PCT/JP2018/003555 dated Mar. 13, 2018.

(Continued)

*Primary Examiner* — Jeffrey J Restifo
(74) *Attorney, Agent, or Firm* — Muncy, Geissler, Olds & Lowe, P.C.

(57) ABSTRACT

A plate body is configured from a bottom part, a side surface part, and a flange part, and is formed in a concave shape, whereby the thickness of the bottom part of the plate body is reduced and the flexibility of a plate is increased. Reducing the thickness of the bottom part of the plate body reduces the length of screws for attaching a snowboard and prevents the screws from inhibiting the flexibility of the plate.

21 Claims, 17 Drawing Sheets

(56) References Cited

U.S. PATENT DOCUMENTS 5,876,045 A * 3/1999 Acuna, Jr. ..... A63C 10/18 280/14.24
5,909,893 A * 6/1999 Keller ..... A63C 10/20 280/607
5,967,542 A * 10/1999 Williams ..... A63C 10/20 280/14.24
6,015,161 A * 1/2000 Carlson ..... A63C 5/128 280/626
6,062,584 A * 5/2000 Sabol ..... A63C 10/14 280/607
6,068,283 A * 5/2000 Couderc ..... A63C 10/08 280/618
6,234,494 B1 * 5/2001 Gien ..... A63C 10/18 280/14.22
6,467,794 B1 * 10/2002 De France ..... A63C 10/14 280/607
6,520,531 B1 * 2/2003 Gien ..... A63C 10/18 280/14.24
6,575,489 B1 * 6/2003 White ..... A63C 10/14 280/14.24
6,655,700 B1 * 12/2003 Caputo ..... A63C 10/10 280/11.3
6,676,152 B2 * 1/2004 Gonthier ..... A63C 10/18 280/14.22
6,783,146 B1 * 8/2004 Coing ..... A63C 10/18 248/292.12
6,786,502 B2 * 9/2004 Carlson ..... A63C 5/128 280/14.22
6,808,183 B2 * 10/2004 Schaller ..... A63C 10/20 280/14.22
6,817,622 B2 * 11/2004 Dodge ..... A63C 10/20 280/14.22
6,910,706 B2 * 6/2005 Holzer ..... A63C 5/128 280/14.24
6,945,544 B2 * 9/2005 Feurer ..... A63C 10/18 280/14.22
6,945,837 B2 * 9/2005 Crumrine ..... B63B 32/35 441/70
7,063,346 B2 * 6/2006 Elkington ..... A63C 10/14 280/11.3
7,168,710 B1 * 1/2007 Hennebry ..... A63C 10/14 280/14.22
7,281,717 B2 * 10/2007 Sacco ..... A63C 10/14 280/14.22
7,290,785 B2 * 11/2007 Dixon ..... A63C 10/14 280/14.24
7,300,070 B2 * 11/2007 Pelchat ..... A63C 5/128 280/14.24
7,390,010 B2 * 6/2008 Elkington ..... A63C 10/14 280/11.3
7,490,859 B2 * 2/2009 Coing ..... A63C 10/18 280/14.21
7,766,363 B2 * 8/2010 Farcot ..... A63C 10/18 280/618
7,980,567 B2 * 7/2011 Yu ..... A63C 17/18 280/11.221
8,052,157 B2 * 11/2011 Holzer ..... A63C 10/18 280/14.24
8,104,776 B2 * 1/2012 Messmer ..... A63C 9/081 280/14.24
8,104,786 B2 * 1/2012 Fumagalli ..... A63C 10/26 280/617
8,132,818 B2 * 3/2012 Cunningham ..... A63C 10/285 280/14.24
8,167,321 B2 * 5/2012 Cunningham ..... A63C 10/285 280/14.24
8,191,917 B2 * 6/2012 Wang ..... A63C 10/045 280/611
8,276,921 B2 * 10/2012 Walker ..... A63C 9/0802 280/14.24
8,596,668 B2 * 12/2013 Van Bregmann, Jr. ..... A63C 10/18 280/618
8,662,505 B2 * 3/2014 Cunningham ..... A63C 10/18 280/14.24
8,870,212 B2 * 10/2014 Noyes ..... A63C 10/18 280/612
8,894,075 B2 * 11/2014 Walker ..... A63C 10/145 280/14.24
9,364,739 B2 * 6/2016 Reguis ..... A63C 5/128
9,452,344 B2 * 9/2016 Ritter ..... A63C 5/031
10,065,102 B2 * 9/2018 Reguis ..... A63C 10/18
10,279,240 B2 * 5/2019 Smith ..... A63C 10/14
2015/0031253 A1 1/2015 Reguis et al.

OTHER PUBLICATIONS

The extended European Search Report of the corresponding EP18784793 dated Dec. 11, 2020.

* cited by examiner

PLATE FOR SNOWBOARD BINDING

TECHNICAL FIELD

The present invention relates to a plate for attaching a snowboard binding to a snowboard.

BACKGROUND ART

A binding is used to mount a boot onto a snowboard. In other words, a boot is mounted onto a snowboard via a binding. For the attachment of such a binding to a snowboard, a plate disclosed in Patent Document 1 may be used, for example.

The plate described above is disk-like and is made to be hard and have a predetermined thickness so as to allow for the attachment of a binding, and on a circumferential edge of a bottom face of the plate, teeth are formed in a circumferential direction. The plate also has a plurality of insertion through holes, through which screws are inserted to secure the plate to the snowboard. A bottom of the binding to be attached to the snowboard by means of the plate has a circular opening. On a circumferential edge of the opening, teeth that engage or mesh with the corresponding teeth of the plate are formed in the circumferential direction. The opening is formed to have a diameter that corresponds to the diameter of the plate and is also formed to have a depth that corresponds to the predetermined thickness of the plate.

In order to attach the binding to the snowboard by means of this plate, first, the plate is placed on the opening of the bottom of the binding at a desired angle such with both teeth meshing with each other. Then, the screw is inserted through the insertion through hole of the plate and screwed into a threaded hole formed in the snowboard. As a result, the plate presses the bottom of the binding from above and the binding is attached to the snowboard.

CITATION LIST

Patent Literature

Patent Document 1: Japanese Patent Application Laid-open No. 2007-143727 (JP2007-143727A)

SUMMARY OF INVENTION

Technical Problem

The above plate disclosed in Patent Document 1 is disk-like and hard and has a predetermined thickness. The screws that are formed from hard members and are relatively long so as to conform to the predetermined thickness of the disk-like plate are used to secure the plate to the snowboard. The flexibility of the plate is therefore impaired when the snowboard is used to glide.

Due to the impaired flexibility of the plate, the binding and the snowboard are deprived of the flexibility that the binding and the snowboard are expected to provide, and there lies a hidden problem in that the binding and the snowboard cannot demonstrate the adequate flexibility that the binding and the snowboard were originally designed to demonstrate.

The present invention has been contrived in view of the circumstances described above and an object of the present invention is to provide a plate for a snowboard binding with which flexibility of a binding and a snowboard can sufficiently be demonstrated.

Solution to Problem

A plate for a snowboard binding to achieve the object described above according to the present invention is accommodated in an opening that is formed in a bottom of the binding and has teeth on a circumferential edge of the opening, the plate serving to press the binding against the snowboard and attaching the binding to the snowboard by being secured to the snowboard by means of a screw, the plate being characterized by comprising:

a bottom having a circular shape, an insertion through hole through which the screw is inserted being formed in the bottom; a side face provided on a circumferential edge of the bottom; a flange provided on an upper edge of the side face and protruding outward in a radial direction; and teeth provided on a lower side of the flange and configured to mesh with the teeth of the binding.

The plate may include a ring, an upper surface of the ring being configured to be attached to a lower surface of the flange, the teeth of the plate for a snowboard binding being formed on a lower surface of the ring, and an outer circumferential edge of the flange may be formed in the shape of a curved surface protruding toward an outer side in the radial direction and obliquely upward.

The plate may include a ring attached to the lower side of the flange, the teeth of the plate for a snowboard binding being formed on a lower surface of the ring, and the flange may be inclined downward toward an outer side in the radial direction.

The teeth of the plate for a snowboard binding may be formed on a lower surface of the flange.

The side face may be inclined upward toward an outer side in the radial direction, and an inner circumferential surface of the opening of the binding may be perpendicular to the snowboard.

The side face may be inclined upward toward an outer side in the radial direction, and an inner circumferential surface of the opening of the binding may be inclined upward toward the outer side in the radial direction of the opening, and an inclination angle of the inner circumferential surface may be smaller than an inclination angle of the side face.

Each mountain part of the teeth of the plate for a snowboard binding may include an inclined surface inclined upward toward an inner side from a lower vertex of a radially outermost surface of the teeth to an uppermost end of the teeth on a base side, and each valley part of the teeth of the binding may include an inclined surface configured to abut against the inclined surface of the mountain part of the teeth of the plate for a snowboard binding and being inclined downward toward an outer side from an uppermost end of an innermost surface of the teeth in the radial direction of the opening to a lowermost portion of the teeth on an outermost side in the radial direction of the opening.

The plate may include slits formed in at least one from among the bottom, the side face, and the flange.

The plate may include slits formed in the ring.

The slits may be provided in radial fashion.

A longitudinal direction of the slits may coincide with a longitudinal direction of the snowboard.

A longitudinal direction of the slits may coincide with a width direction of the snowboard.

The plate may include a hole formed in a center of the bottom.

The plate may include a plurality of ribs formed on the bottom from a circumferential edge side toward a center of the bottom.

The ribs may be provided in radial fashion.

The plate may include ribs formed on the bottom in a form of intersecting each other in an X-shape.

A hole may be formed at a portion where the ribs intersect each other in an X-shape.

The plate may include a rib formed on the bottom, a longitudinal direction of the rib coinciding with a longitudinal direction of the snowboard.

The plate may include a rib formed on the bottom, a longitudinal direction of the rib coinciding with a width direction of the snowboard.

The bottom, the side face, and the flange may be formed from a thin plate.

A material of the bottom, the side face, and the flange may be pure titanium, a titanium alloy, stainless steel, or maraging steel.

A material of the teeth of the plate for a snowboard binding may be pure titanium, a titanium alloy, stainless steel, or maraging steel.

Advantageous Effects of Invention

According to the present invention, there can be provided a plate for a snowboard binding with which flexibility of a binding and a snowboard can sufficiently be demonstrated.

DESCRIPTION OF EMBODIMENTS

A plate for a snowboard binding according to embodiments of the present invention will be described below with reference to the drawings.

First Embodiment

A plate for a snowboard binding according to a first embodiment will be described with reference to FIGS. 1 to 6. As illustrated in FIGS. 2 and 6, the plate 1 for a snowboard binding (hereinbelow, "plate") serves to press a binding 2, which is used to mount a boot to a snowboard 3, against the snowboard 3 to attach the same to the snowboard 3. Note that in FIG. 6 and FIGS. 7 to 11 described later, an X direction indicates a longitudinal direction of the snowboard 3 (gliding direction) and a Y direction indicates a width direction of the snowboard 3.

Figure 1:
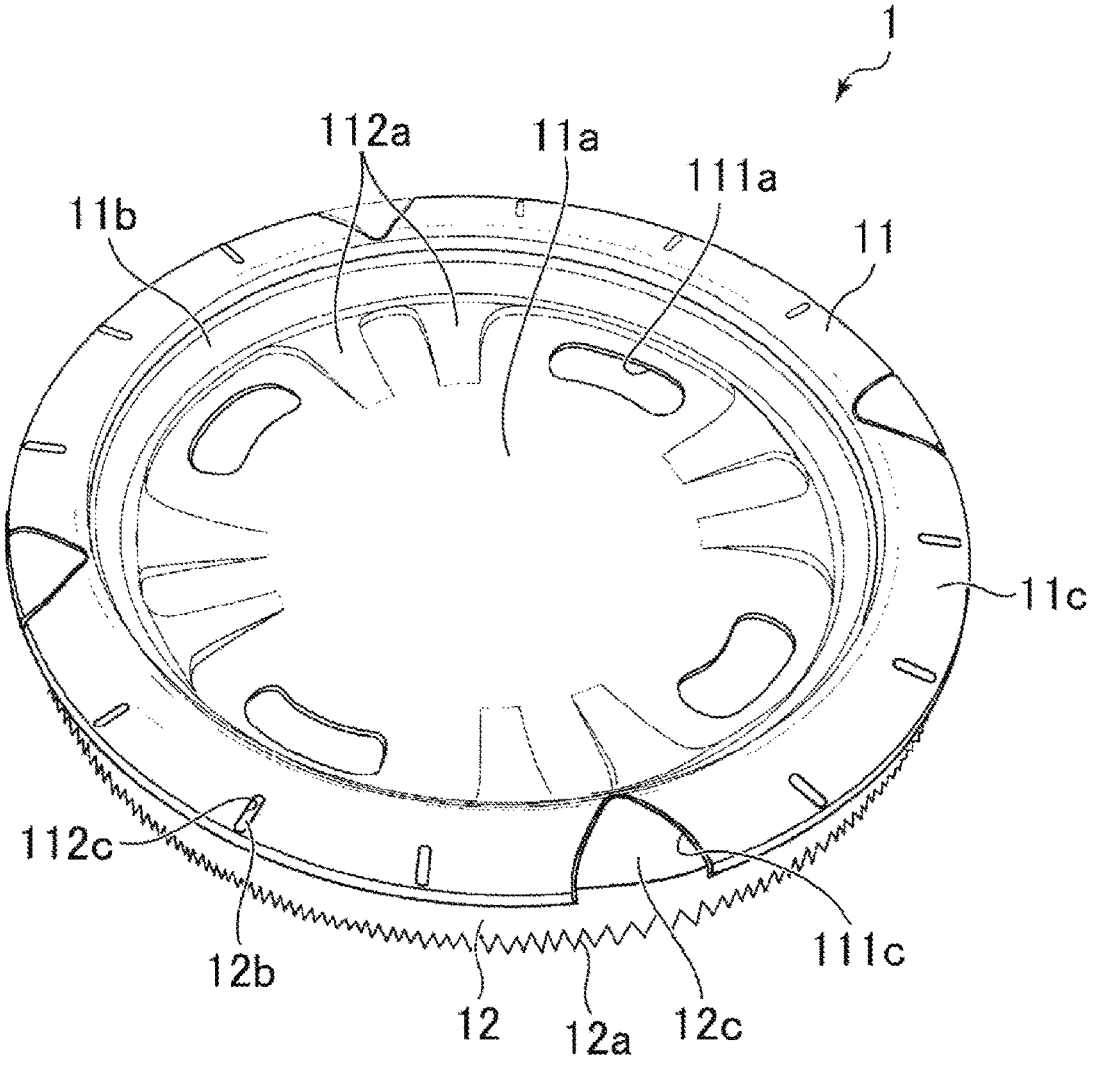
FIG. 1 is a perspective view, illustrating a configuration of a plate for a snowboard binding according to a first embodiment of the present invention.
Figure 2:
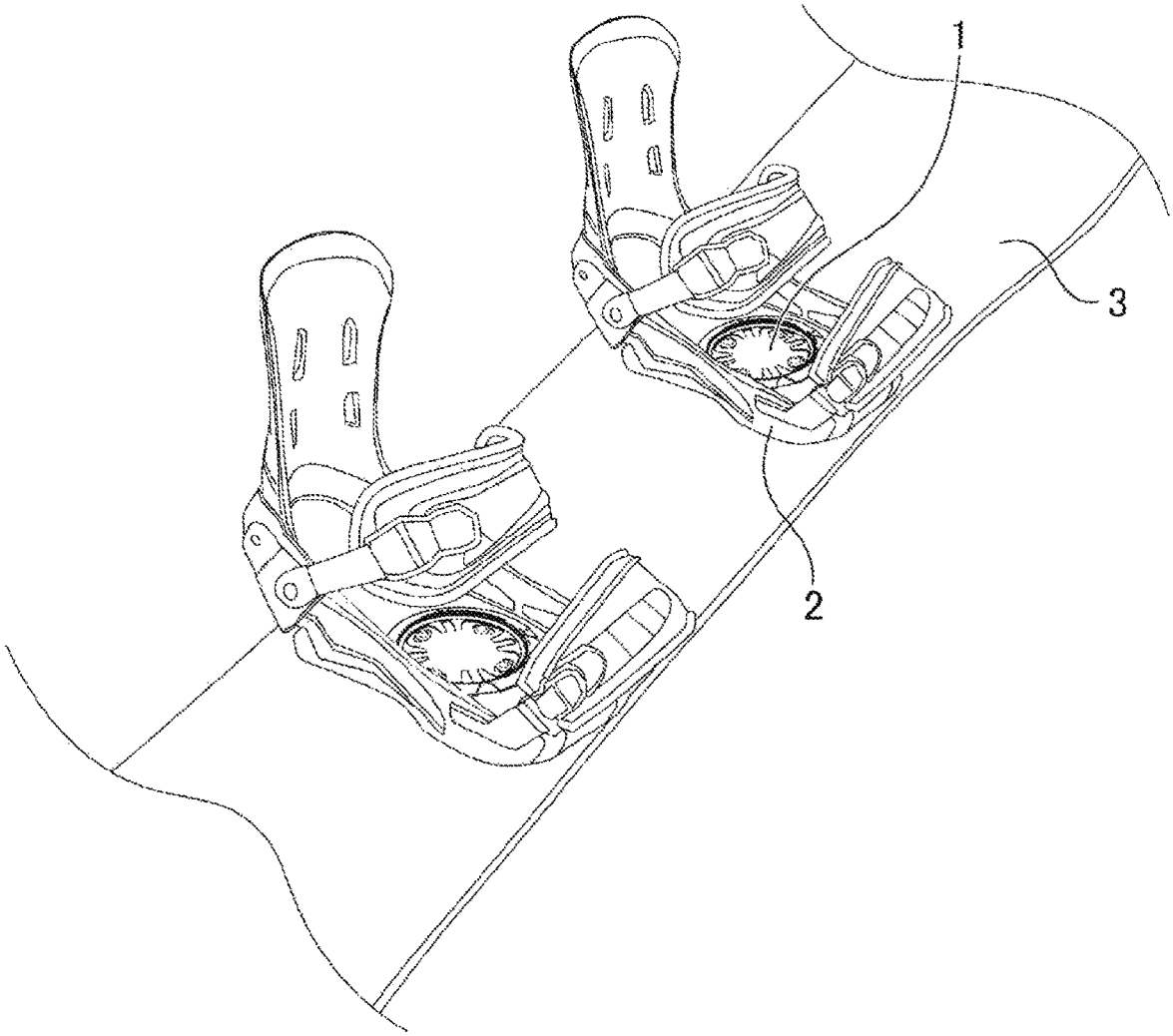
FIG. 2 is a perspective view, illustrating a state where a binding is attached to a snowboard using the plate for a snowboard binding according to the first embodiment.
Figure 3:
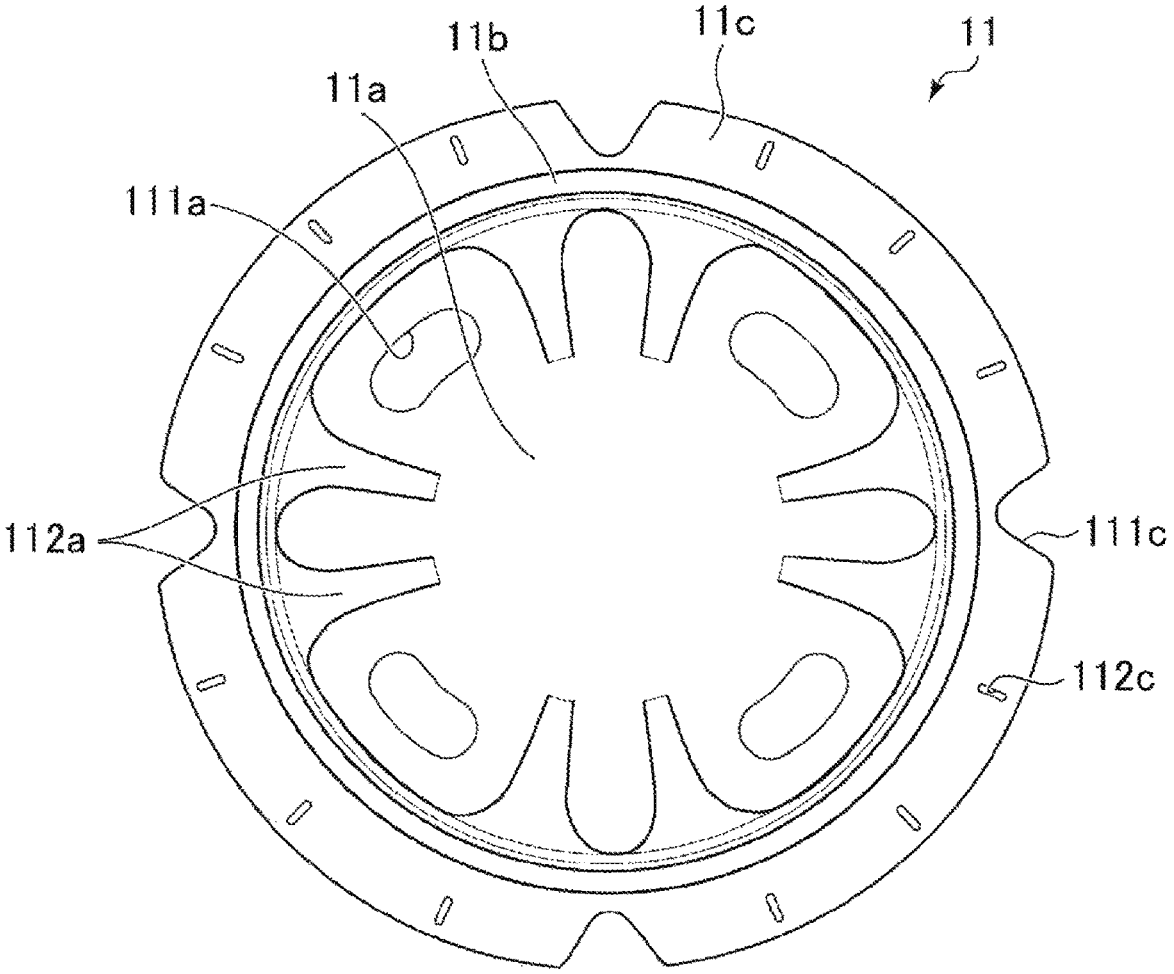
FIG. 3 is a plan view, illustrating a configuration of a plate body included in the plate for a snowboard binding illustrated in FIG. 1.

As illustrated in FIG. 1, the plate 1 is configured in such a manner that a ring 12 having teeth 12*a* is attached to a plate body 11. As illustrated in FIGS. 1 and 3, the plate body 11 is formed from a circular bottom 11*a*, a side face 11*b* provided on a circumferential edge of the bottom 11*a*, and a flange 11*c* provided on an upper edge of the side face 11*b* and protruding outward. Examples of materials that may be used for the plate body 11 include pure titanium, a titanium alloy, stainless steel, maraging steel, etc. It is preferred that the thickness of the plate body 11 be less than or equal to 2 mm, and although the thickness can be reduced to about 0.3 mm, it is more preferred that the thickness be 0.6 mm.

In the circular bottom 11*a*, there are formed a plurality of screw insertion through holes 111*a* through which screws 4 for securing the plate 1 to the snowboard 3 are inserted, and ribs 112*a*. Four such screw insertion through holes 111*a* are disposed in the bottom 11*a* at equal intervals in the circumferential direction. The screw insertion through holes 111*a* are each formed into the shape of a circular arc on the same circumference; accordingly, an angle at which the plate 1 is attached to the snowboard 3 using the screws 4 can be adjusted.

The ribs 112*a* serve to efficiently transmit force from a snowboarder (a person who glides) to the binding 2 and the snowboard 3 via the plate 1. While flexibility of the plate 1 is maintained, the plate 1 is hardened only along the longitudinal direction of the ribs 112*a*, and in this direction, the snowboarder can efficiently transmit force to the binding 2 and the snowboard 3 via the plate 1.

Each rib 112*a* is formed from the circumferential edge of the bottom 11*a* toward the center thereof. The rib 112*a* is shaped such that the rib 112*a* is mildly sloped and widened toward the circumferential edge side of the bottom 11*a*. A total of eight such ribs 112*a* are provided in pairs that are disposed in four locations by being separated from one another at equal intervals in the circumferential direction.

Figure 5A:
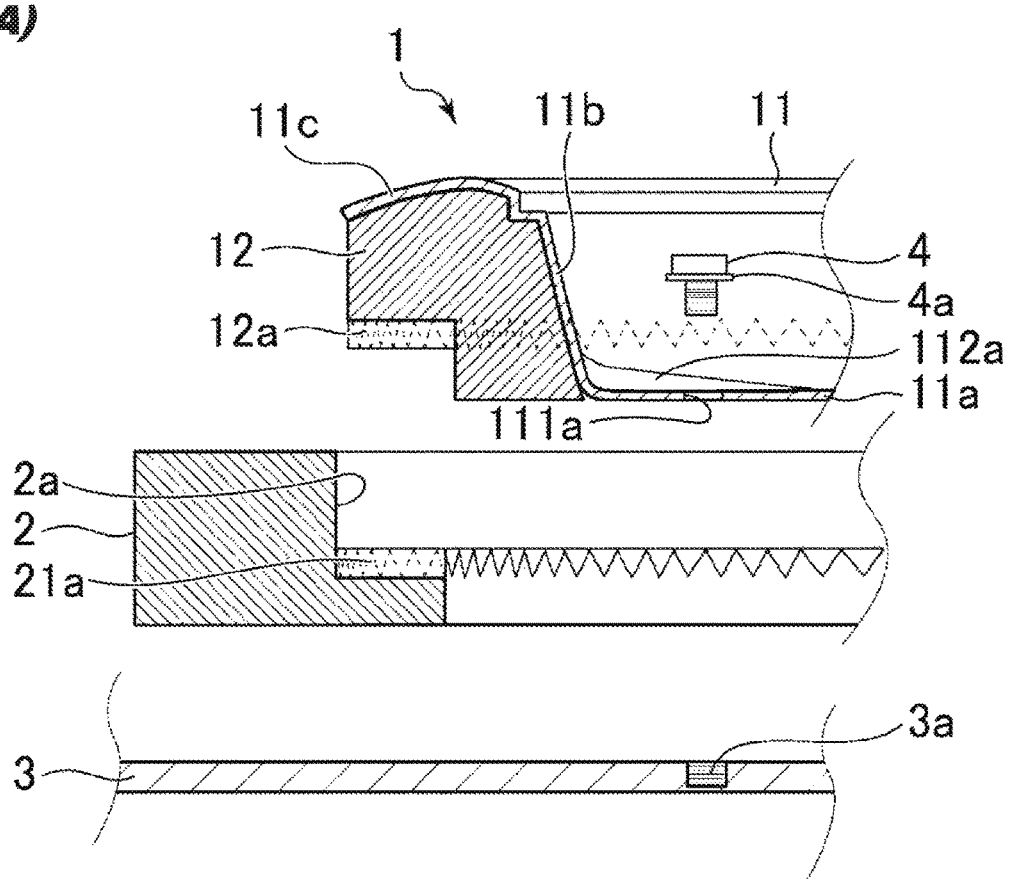
FIG. 5(A) is an explanatory schematic and partially cross-sectional diagram, illustrating a state before the binding is attached to the snowboard using the plate for a snowboard binding according to the first embodiment.

As illustrated in FIG. 5, an outer circumferential edge of the flange 11*c* is formed in the shape of a curved surface that protrudes toward an outer side in the radial direction of the plate 1 and obliquely upward. Four substantially V-shaped slits 111*c* are formed on the flange 11*c* while being separated from one another at equal intervals. The slits 111*c* are formed for the purposes of enhancing the flexibility of the binding 2 and the snowboard 3 via the plate 1 and making the meshed state of the teeth 12*a* of the plate 1 and the teeth 21*a* (described later) of the binding 2 favorable. Each slit 111*c* is disposed so as to be located between two ribs 112*a* forming a pair in the circumferential direction of the plate 1. Due to such disposition of the slits 111*c* and the ribs 112*a* in the plate 1, it is possible to adjust the influence exerted by the ribs 112*a* on hardness and the influence exerted by the slit 111*c* on flexibility.

Fitting holes 112*c* to which small protrusions 12*b* (described later) of the ring 12 are fit are formed in the flange 11*c* along the circumferential direction. The side face 11*b* is inclined upward toward the outer side in the radial direction of the plate 1.

Figure 4A:
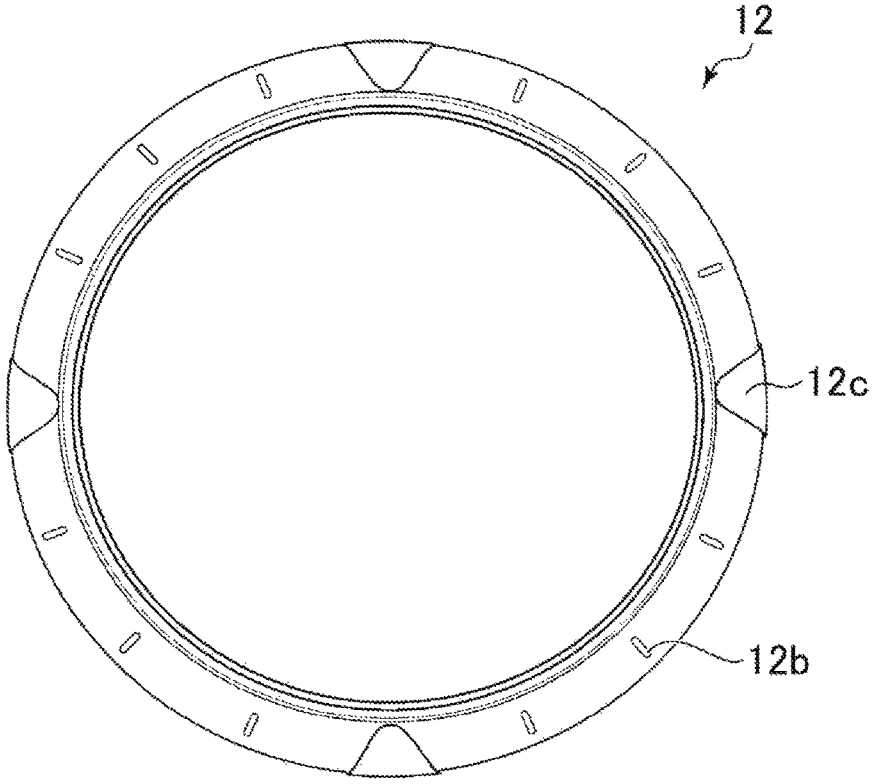
FIG. 4(A) is a plan view, illustrating a configuration of a ring included in the plate for a snowboard binding illustrated in FIG. 1.
Figure 4B:
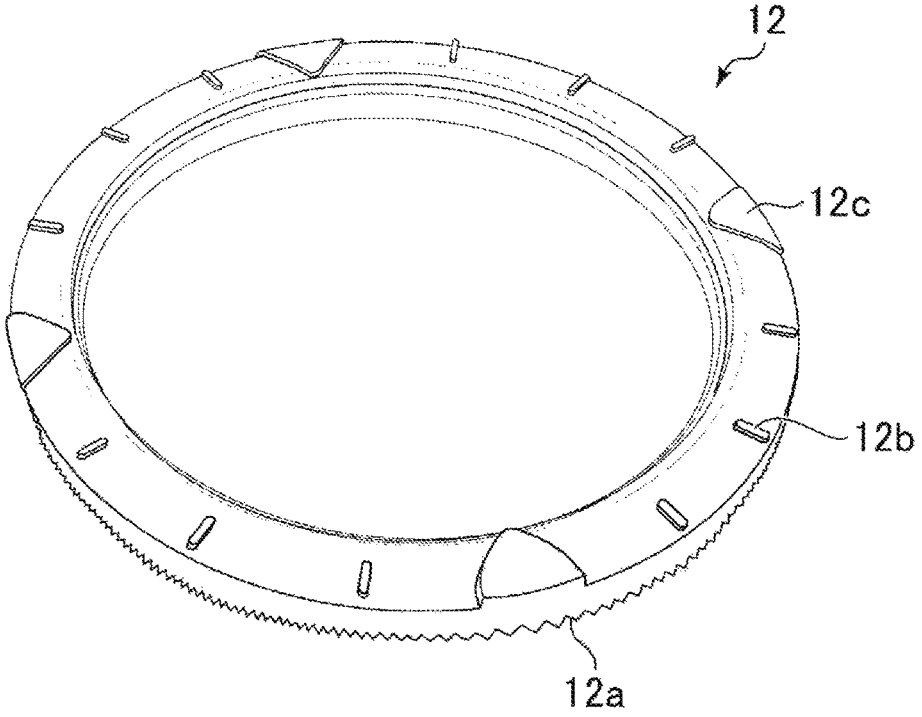
FIG. 4(B) is a perspective view, illustrating a configuration of the ring included in the plate for a snowboard binding illustrated in FIG. 1.

As illustrated in FIGS. 1 and 4(B), a serrated teeth 12*a* is formed on a lower surface of the ring 12, the teeth 12*a* being continuous in the circumferential direction. As illustrated in FIGS. 1 and 4, on an upper surface of the ring 12, there are formed a plurality of the small protrusions 12*b* along the circumferential direction and four protrusions 12*c* that are separated from one another at equal intervals along the circumferential direction. The protrusions 12*c* are formed into a shape such that the protrusions 12*c* fit to the substantially V-shaped slits 111*c* of the plate body 11. As illustrated in FIG. 5, the upper surface of the ring 12 is formed in conformity with the shape of the flange 11*c* of the plate body 11 and the outer circumferential edge of the upper surface is formed in the shape of a curved surface that protrudes toward the outer side in the radial direction of the plate 1 and obliquely upward. The inner circumferential surface of the ring 12 is also formed in conformity with the shape of the side face 11*b* of the plate body 11, and is formed so as to be inclined upward toward the outer side in the radial direction of the plate 1. Examples of materials that may be used for the ring 12 include a magnesium alloy, synthetic resin, etc.

Now, with reference to FIG. 5 and the like, a method for attaching the binding 2 to the snowboard 3 using the plate 1 will be described. As illustrated in FIG. 5, a circular opening 2*a* serving to accommodate the plate 1 is formed in the bottom of the binding 2. The opening 2*a* is formed such that the diameter thereof corresponds to the diameter of the plate 1. The serrated teeth 21*a*, which meshes with the teeth 12*a* of the plate 1, is formed on a circumferential edge of the opening 2*a*, the teeth 21*a* being continuous in the circumferential direction. A plurality of threaded holes 3*a* into which the screws 4 are screwed are formed in the snowboard 3.

First, as illustrated in FIG. 1, the small protrusions 12*b* of the ring 12 are fit into the fitting holes 112*c* of the plate body 11 and the protrusions 12*c* of the ring 12 are fit to the slits 111*c* of the plate body 11, thereby attaching the ring 12 to the lower surface side of the flange 11*c* of the plate body 11.

Next, the plate 1 is accommodated in the opening 2*a* of the bottom of the binding 2 in such a manner that the teeth 12*a* of the plate 1 and the teeth 21*a* on the circumferential edge of the opening 2*a* of the binding 2 mesh with each other. By accommodating the plate 1 in the opening 2*a* of the binding 2 while adjusting the accommodation angle of the same, the binding 2 can be attached to the snowboard 3 at a desired angle.

Figure 5B:
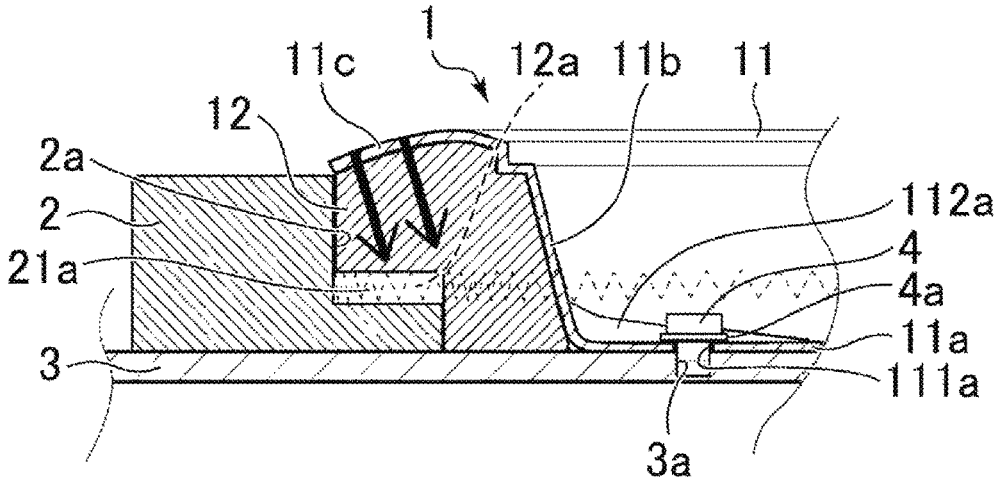
FIG. 5(B) is an explanatory schematic and partially cross-sectional diagram, illustrating a state after the binding has been attached to the snowboard using the plate for a snowboard binding according to the first embodiment.
Figure 6:
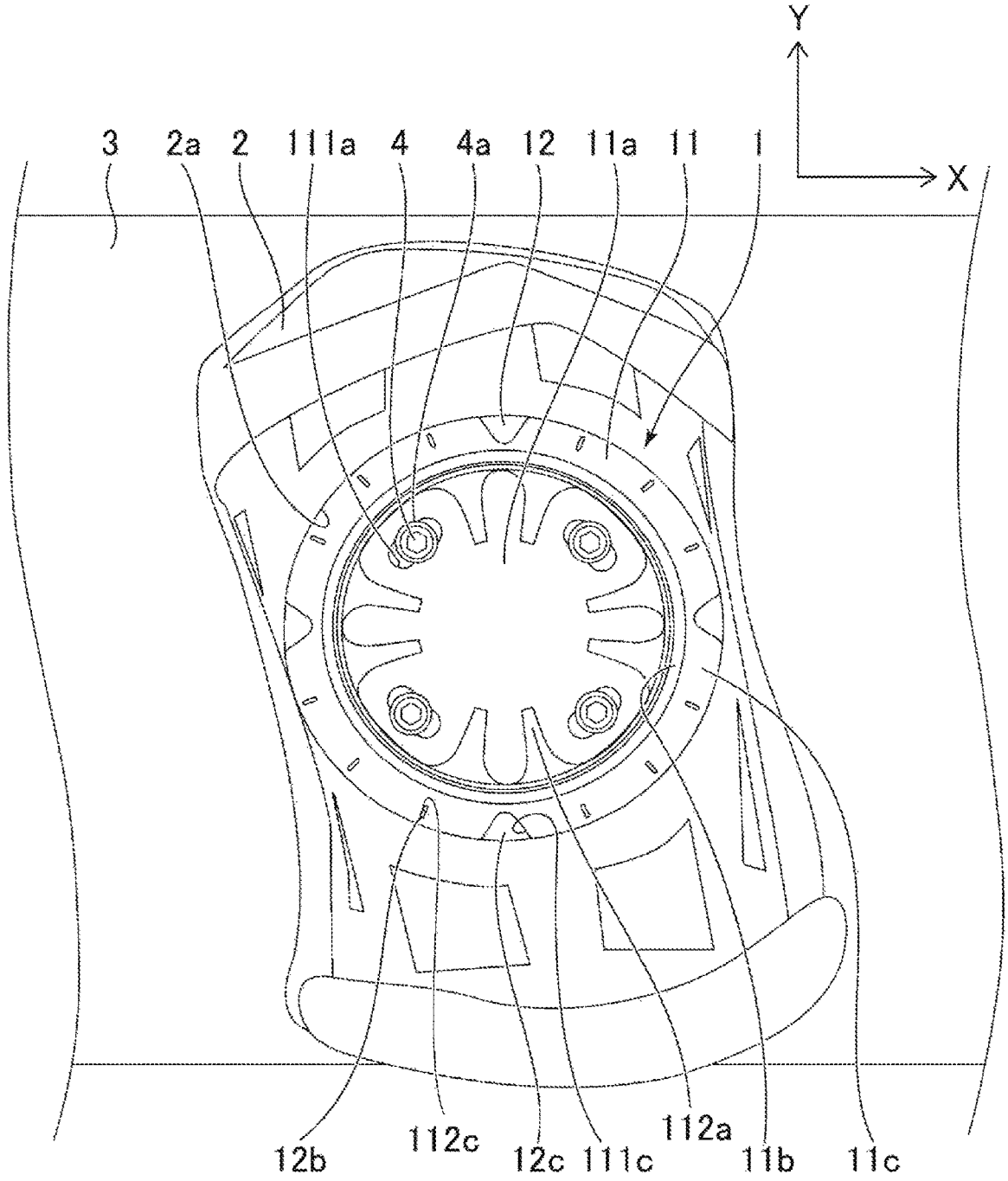
FIG. 6 is a plan view, illustrating a state where the binding is attached to the snowboard using the plate for a snowboard binding according to the first embodiment.

Then, as illustrated in FIG. 5(B), each screw 4 is inserted through a washer 4*a* and the insertion through hole 111*a* of the plate 1 and screwed into the threaded hole 3*a* of the snowboard 3 so that the plate 1 and the binding 2 are attached to the snowboard 3.

Note that when it is intended to adjust the angle at which the plate 1 is attached to the snowboard 3, the screws 4 may be removed while the position of the binding 2 remains fixed and the angle of attachment of the plate 1 may be adjusted within ranges in which the positions of the circular arc-shaped screw insertion through holes 111*a* and the threaded holes 3*a* of the snowboard 3 overlap one another, after which the screws 4 may be inserted through the washers 4*a* and the screw insertion through holes 111*a* and screwed anew into the threaded holes 3*a*. This adjustment is carried out when, for example, it is intended to slightly adjust the disposition, angle, and so on, of the ribs 112*a* or the slits 111*c* in relation to the snowboard 3.

As described above, for the plate of the present embodiment, the plate body 11 is formed from the bottom 11*a*, the side face 11*b*, and the flange 11*c* such that the plate body 11 has a recessed shape, and thus the thickness of the bottom 11*a* of the plate body 11 can be reduced compared to conventional disk-like plates having a predetermined thickness; as a result, flexibility of the plate 1 is increased. Moreover, as a result of the bottom 11*a* of the plate body 11 being formed from a thin plate, the length of the screws 4 can be reduced, so flexibility of the plate 1 can be prevented from being impaired by the screws 4. Due to such an increase in the flexibility of the plate 1, the flexibility of the binding 2 and the snowboard 3 also increases, so that the flexibility according to the original design can be demonstrated and the gliding properties of the snowboard 3 can be improved.

When the snowboarder makes a turn with the snowboard 3 while gliding, the snowboard 3 is bent according to the action of leverage, where the plate 1 serves as a fulcrum joining the snowboard 3 and the binding 2. The plate of the present embodiment is highly flexible and thus, as a fulcrum, provides a loose joint between the snowboard 3 and the binding 2; therefore, restrictions on a movable range for the leg can be made relatively relaxed, and a load placed on the knee during a glide can be alleviated while the action of leverage being moderated. Furthermore, there have been situations where, for example, when having only one leg secured to the binding 2 while riding on a lift in a ski resort, fastening of the binding 2 was loosened so as to provide enough movable range for the leg and thereby alleviate the load placed on the knee; with the plate of the present embodiment, however, since the plate is highly flexible so that the load placed on the knee can be alleviated, it is possible to ride on a lift without loosening the fastening of the binding 2.

In addition, since the plate of the present embodiment has enhanced flexibility as described above, it is possible to prevent deterioration in the meshing of the teeth 12*a* of the plate 1 and the teeth 21*a* of the binding 2. In the related art, a binding is relatively flexible with respect to a poorly flexible disk-like plate, so when force acts on the plate during a glide, the binding undergoes relatively large deformation, leading to deterioration in the meshing between the teeth of the plate and the teeth of the binding. This plate 1 having enhanced flexibility can prevent such deterioration in the meshing between the teeth of the plate and the binding.

Moreover, in the plate of the present embodiment, the outer circumferential edge of the flange 11*c* is formed in the shape of a curved surface that protrudes toward the outer side in the radial direction of the plate 1 and obliquely upward, so also from this perspective, favorable meshing between the teeth 12*a* of the plate 1 and the teeth 21*a* of the binding 2 during a glide with the snowboard 3 can be maintained During a glide with the snowboard 3, the snowboard 3 bends from the central part toward both ends, and the plate 1 and the binding 2 also bend in conformity with the bending of the snowboard 3. Accordingly, the site at which the teeth 12*a* of the plate 1 and the teeth 21*a* of the binding 2 mesh is often inclined in such a manner that the outer side of this site in the radial direction of the plate 1 and the radial direction of the opening 2*a* of the binding 2 rises. As described above, the outer circumferential edge of the flange 11*c* of the plate 1 is formed in the shape of a curved surface that protrudes toward the outer side in the radial direction and obliquely upward, so by virtue of this flange 11*c*, force that presses the site, at which the teeth 12*a* of the plate 1 and the teeth 21*a* of the binding 2 mesh (which are inclined during the glide), obliquely downward from above toward the inner side in the radial direction of the plate 1 acts more readily. As a result, the meshing of the teeth 12*a* of the plate 1 and the teeth 21*a* of the binding 2 is prevented from diverging during a glide with the snowboard 3.

Moreover, since the plate of the present embodiment includes the slits 111*c*, flexibility of the plate can be further enhanced and, accordingly, flexibility of the binding 2 and the snowboard 3 can also be enhanced further, in addition to which deterioration in the meshing of the teeth 12*a* of the plate 1 and the teeth 21*a* of the binding 2 can be prevented to an even greater extent.

The plate of the present embodiment is provided with the ribs 112*a* that are disposed in four locations in the circumferential direction by being separated at equal intervals, and as illustrated in FIG. 6, the ribs 112*a* are disposed such that the longitudinal directions thereof coincide more or less with the longitudinal direction (X direction) and the width direction (Y direction) of the snowboard 3. Thus, during a glide, the snowboarder can efficiently transmit force to the snowboard 3 in the longitudinal direction (X direction) and the width direction (Y direction) via the plate 1, with the flexibility of the plate 1 being maintained.

During a glide, a snowboard may absorb dips and bumps as obstruction on the snow surface so that the snowboard undergoes unwanted bending, resulting in a deceleration in the gliding speed. According to the present embodiment, however, force is transmitted efficiently to the snowboard 3 in the longitudinal direction (X direction) by virtue of the ribs 112*a*, and thus absorption of the dips and bumps on the snow surface is mitigated and occurrence of unwanted bending can be limited; therefore, gliding speed can be maintained.

When a snowboard shakes, force that occurs during a turn may dissipate in different directions, resulting in the turn becoming unstable. According to the present embodiment, however, force is transmitted efficiently to the snowboard 3 in the longitudinal direction (X direction) by virtue of the ribs 112*a*, and thus shaking of the snowboard 3 is limited and force that occurs during a turn dissipates less readily; therefore, the turn is stabilized.

According to the present embodiment, force is transmitted efficiently to the snowboard 3 in the width direction (Y direction) by virtue of the ribs 112*a*, so when making a turn, the direction in which the force from the leg is transmitted deviates less readily and a shift of body weight can be controlled more easily; thus, accuracy of a turn is improved. Moreover, a superfluous shift of body weight is reduced, and thus a beneficial effect of the gliding speed being increased is achieved.

In other words, according to the present embodiment, it is possible to ensure both of the following at the same time, namely: operability that is based on the inherent flexibility of the binding 2 and the snowboard 3 as expected by a purchaser as well as on the transmission of force from the leg to the snowboard 3; and user comfort obtained as a result of a load on the knee being alleviated.

With the plate of the present embodiment, weight reduction can also be achieved due to the plate body 11 being formed into a thin plate. Moreover, with the plate of the present embodiment, if pure titanium or a titanium alloy is used for the material of the plate body 11, flexibility can be further enhanced and weight can be further reduced.

First Modification of First Embodiment

Figure 7:
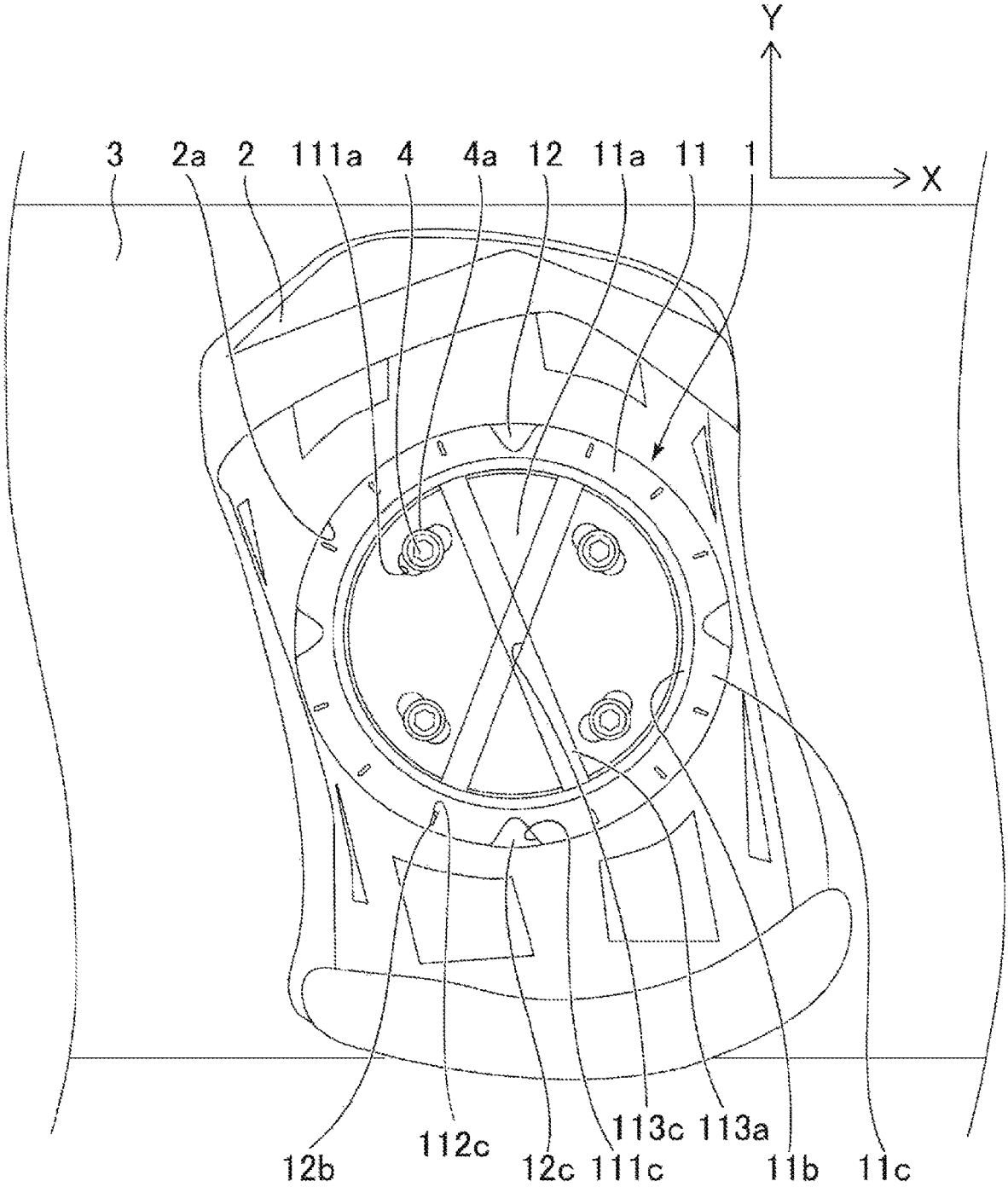
FIG. 7 is a plan view, illustrating a state where the binding is attached to the snowboard using a plate for a snowboard binding according to a first modification of the first embodiment.

Next, a first modification of the first embodiment will be described with reference to FIG. 7. In the first modification, ribs 113*a* formed in the bottom 11*a* of the plate 1 assume a form such that the ribs 113*a* intersect each other in an X-shape, and a rhombic hole 113*c* is formed in the central part, i.e. the site of intersection, in the bottom 11*a*. The ribs 113*a* are formed so as to be long in the width direction (Y direction) of the snowboard 3, so during a glide, the snowboarder can efficiently transmit force to the snowboard 3 in the width direction (Y direction) via the plate 1, with the flexibility of the plate 1 being maintained Moreover, the formation of the rhombic hole 113*c* in the center of the bottom 11*a* of the plate 1 results in an enhancement in flexibility around the center of the bottom 11*a* of the plate 1, which leads to an enhancement in the flexibility of the snowboard 3 directly under the bottom 11*a*. Note that the form of the ribs 113*a*, e.g. the angle at which the ribs 113*a* intersect in an X-shape, may be adjusted, as appropriate, according to the direction of the snowboard 3 in which efficient transmission of force is intended. For example, when force is to be efficiently transmitted in the longitudinal direction (X direction) of the snowboard 3, the ribs 113*a* are formed so as to be long in the X direction.

Second Modification of First Embodiment

Figure 8:
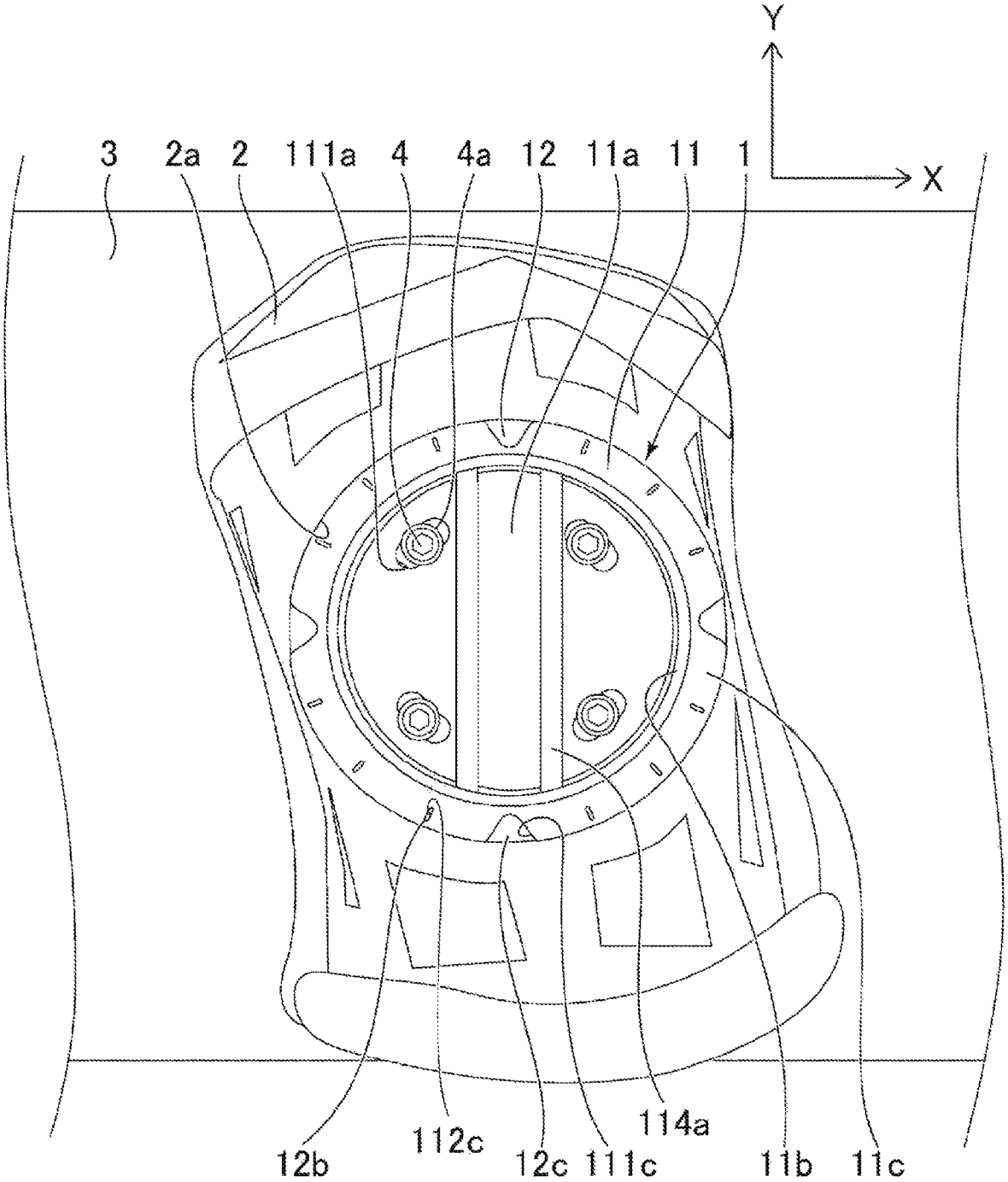
FIG. 8 is a plan view, illustrating a state where the binding is attached to the snowboard using a plate for a snowboard binding according to a second modification of the first embodiment.

A second modification of the first embodiment will be described with reference to FIG. 8. In the second modification, two ribs 114*a* are formed in the bottom 11*a* of the plate 1 so as to be linear in the width direction (Y direction) of the snowboard 3. Since the ribs 114*a* are formed so as to be linear in the width direction (Y direction) of the snowboard 3, during a glide, the snowboarder can efficiently transmit force to the snowboard 3 in the width direction (Y direction) via the plate 1, with the flexibility of the plate 1 being maintained.

Third Modification of First Embodiment

Figure 9:
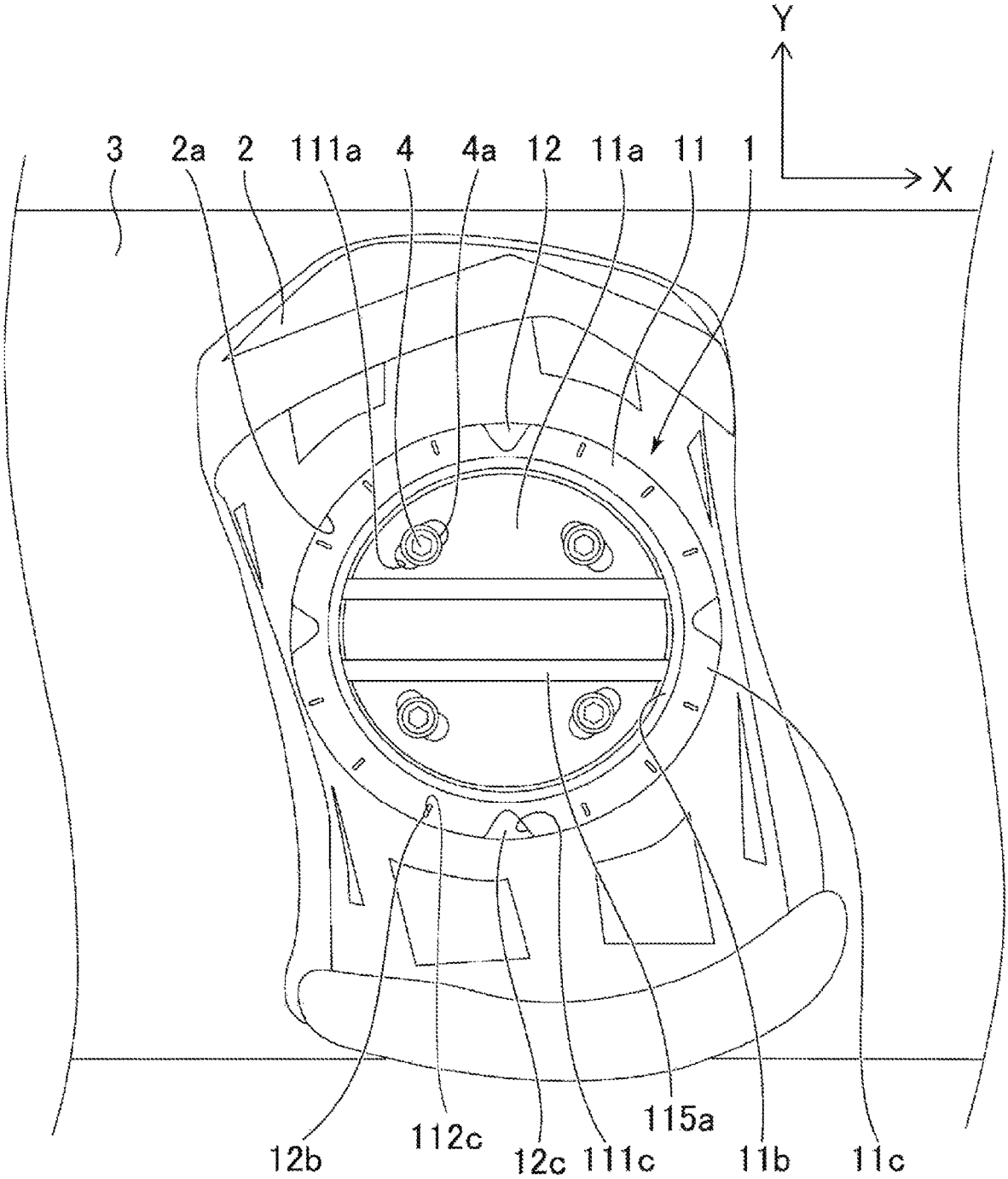
FIG. 9 is a plan view, illustrating a state where the binding is attached to the snowboard using a plate for a snowboard binding according to a third modification of the first embodiment.

A third modification of the first embodiment will be described with reference to FIG. 9. In the third modification, two ribs 115*a* are formed in the bottom 11*a* of the plate 1 so as to be linear in the longitudinal direction (X direction) of the snowboard 3. Since the ribs 115*a* are formed so as to be linear in the longitudinal direction (X direction) of the snowboard 3, during a glide, the snowboarder can efficiently transmit force to the snowboard 3 in the longitudinal direction (X direction) via the plate 1, with the flexibility of the plate 1 being maintained.

Fourth Modification of First Embodiment

Figure 10:
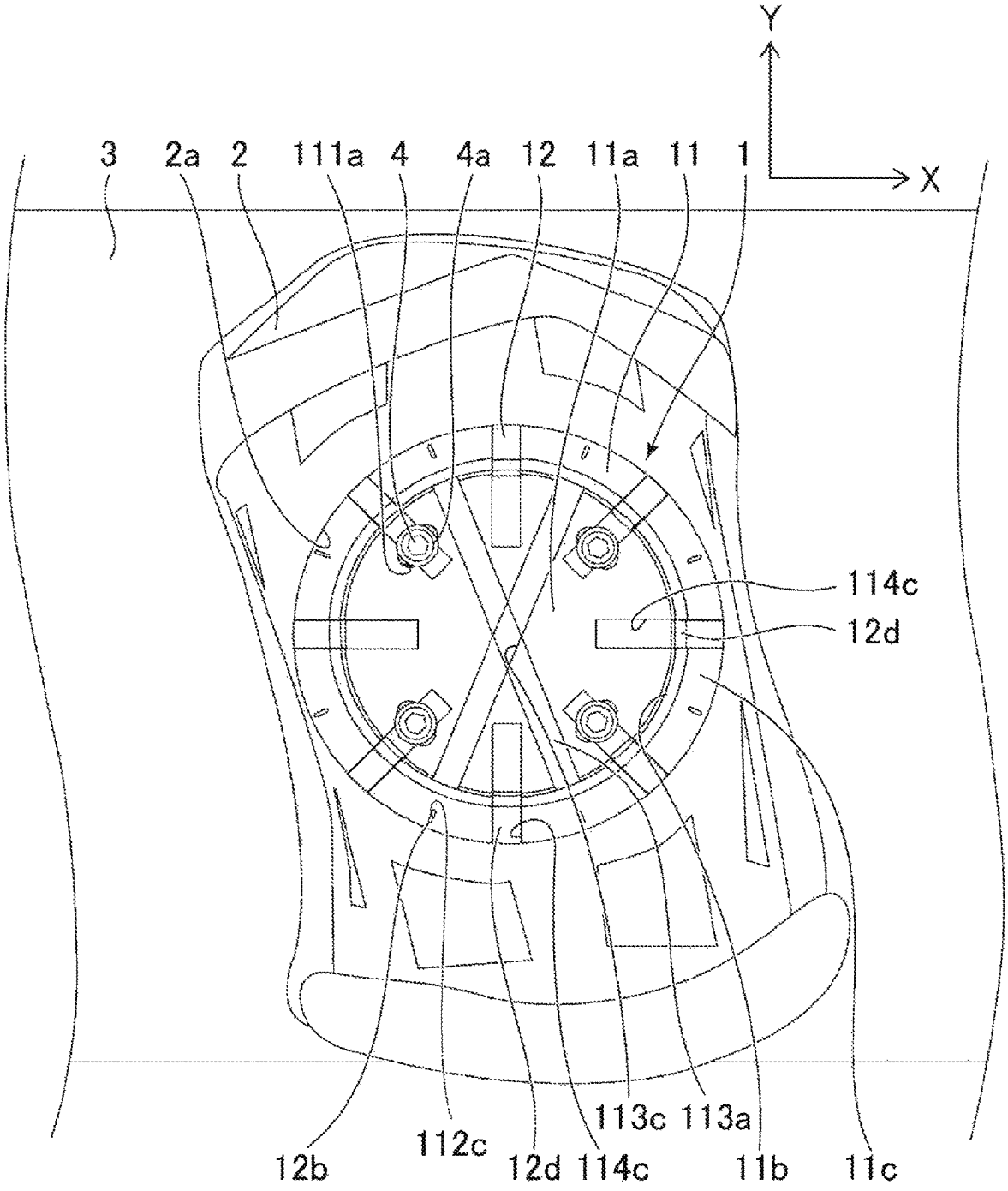
FIG. 10 is a plan view, illustrating a state where the binding is attached to the snowboard using a plate for a snowboard binding according to a fourth modification of the first embodiment.

A fourth modification of the first embodiment will be described with reference to FIG. 10. In the fourth modification, slits 114*c* are formed in the plate 1 in radial fashion. Each slit 114*c* is formed so as to span the flange 11*c*, the side face 11*b*, and the bottom 11*a*. Protrusions 12*d* are formed on the upper surface and an inner surface of the ring 12, each of the protrusions 12*d* being continuous over the upper and inner surfaces, and the protrusions 12*d* are fit to the slits 114*c*. The four slits 114*c* disposed in oblique directions relative to the snowboard 3 are formed so as to be continuous with the screw insertion through holes 111*a* and also serve as screw insertion through holes. In the fourth modification, the ribs 113*a* in the form of intersecting each other in an X-shape and the rhombic holes 113*c* of the first modification are also formed.

The slits 114*c* are formed in the plate 1 in radial fashion, so flexibility can be enhanced in any direction of the plate 1, and accordingly, flexibility can be enhanced for the binding 2 and the snowboard 3 in any direction, in addition to which meshing between the teeth 12*a* of the plate 1 and the teeth 21*a* of the binding 2 can be maintained to be even more favorable.

Fifth Modification of First Embodiment

Figure 11:
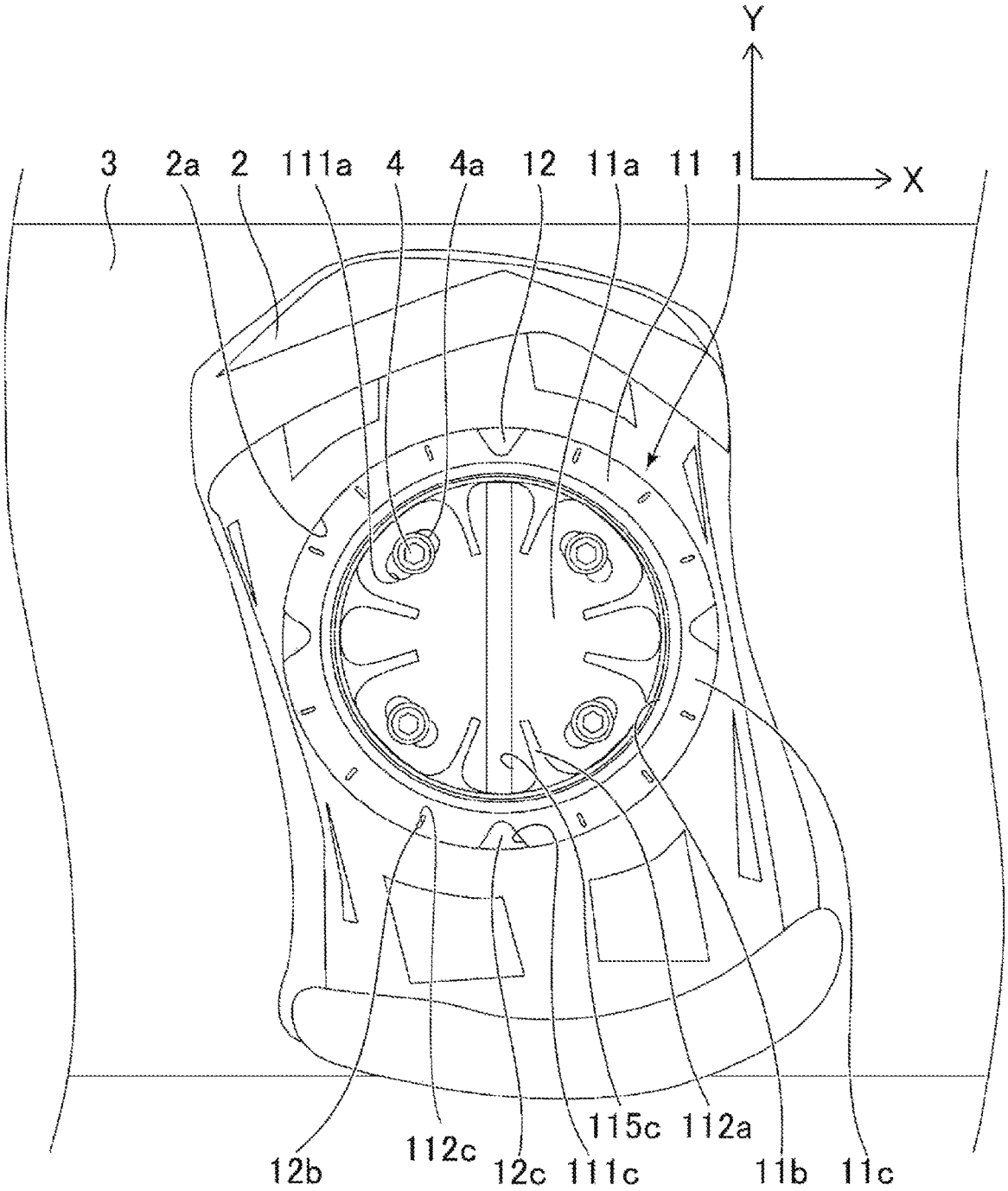
FIG. 11 is a plan view, illustrating a state where the binding is attached to the snowboard using a plate for a snowboard binding according to a fifth modification of the first embodiment.

A fifth modification of the first embodiment will be described with reference to FIG. 11. In the fifth modification, a linear slit 115*c* is formed in the bottom 11*a* of the plate 1 along the diametric direction of the bottom 11*a* and the width direction (Y direction) of the snowboard 3. In the fifth modification, the ribs 112*a* are formed to be somewhat thinner. The linear slit 115*c* is formed along the width direction (Y direction) of the snowboard 3, so through the plate 1, mainly, flexibility of the snowboard 3 can be enhanced in the longitudinal direction (X direction) and force can be efficiently transmitted to the snowboard 3 in the width direction (Y direction). Note that the orientation, or the like, of the linear slit 115*c* may be adjusted, as appropriate, according to the direction in which the flexibility is intended to be enhanced in the snowboard 3. For example, if the flexibility is intended to be enhanced in the width direction (Y direction) of the snowboard, the linear silt 115*c* is formed in the longitudinal direction (X direction).

Sixth Modification of First Embodiment

Figure 12:
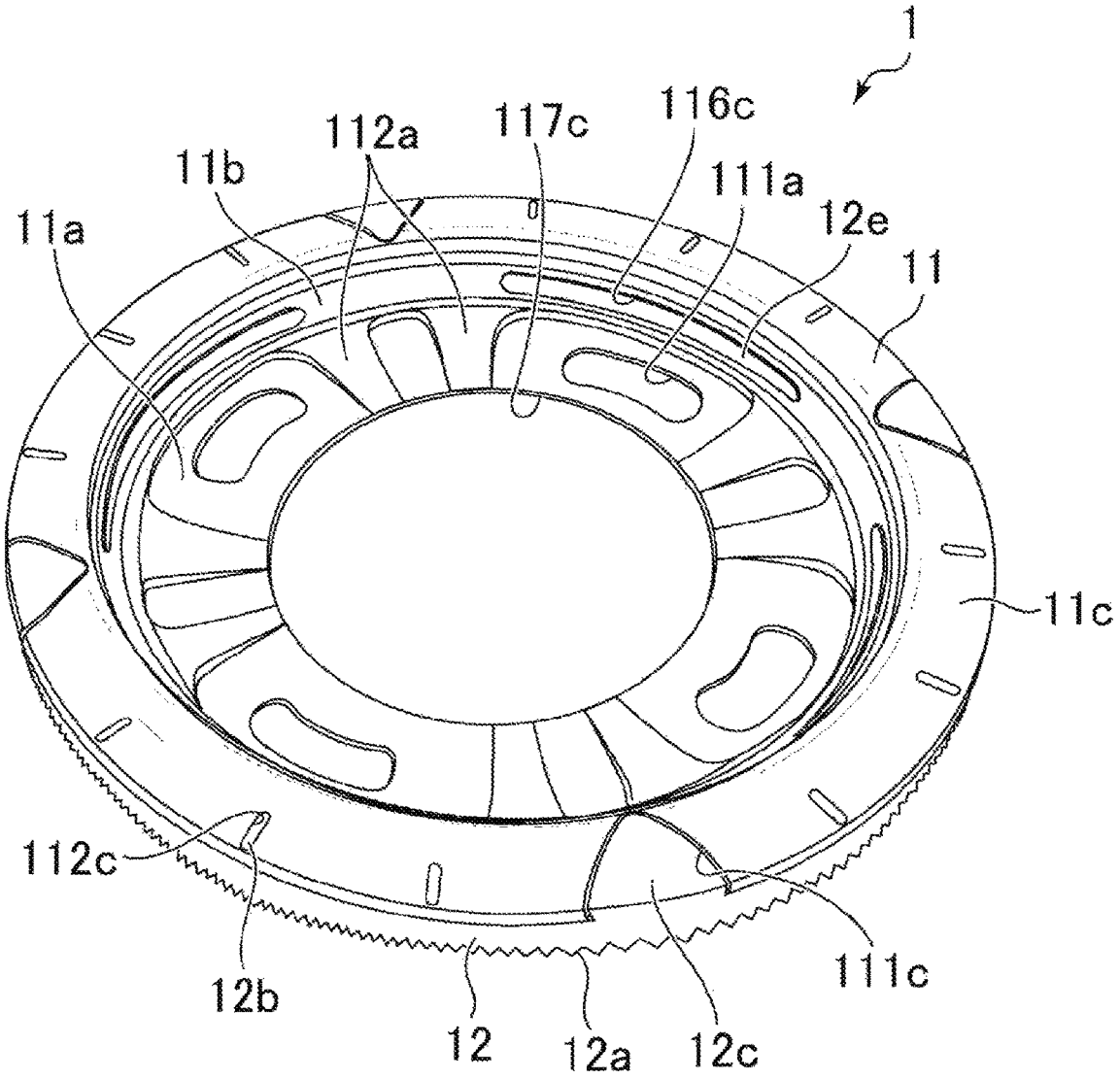
FIG. 12 is a perspective view, illustrating a configuration of a plate for a snowboard binding according to a sixth modification of the first embodiment.

A sixth modification of the first embodiment will be described with reference to FIG. 12. In the sixth modification, in the plate body 11, four slits 116*c* are formed at equal intervals in the side face 11*b* and a circular hole 117*c* is formed in the center of the bottom 11*a*. Protrusions 12*e* that fit to the slits 116*c* are formed on the inner surface of the ring 12. The circular hole 117*c* is formed so as to reach the leading ends of the ribs 112*a* and is formed so as to have a relatively large diameter that corresponds to roughly ⅔ of the diameter of the bottom 11*a* of the plate body 11. The slits 116*c* formed in the side face 11*b* of the plate body 11 directly enhance the flexibility of the side face 11*b* of the plate body 11 and therefore mainly serve to enhance the flexibility of the binding 2 near the side face 11*b*. The circular hole 117*c* formed in the bottom 11*a* of the plate body 11 directly enhances the flexibility of the bottom 11*a* and therefore mainly serves to enhance the flexibility of the snowboard 3 directly under the bottom 11*a*.

Seventh Modification of First Embodiment

Figure 13:
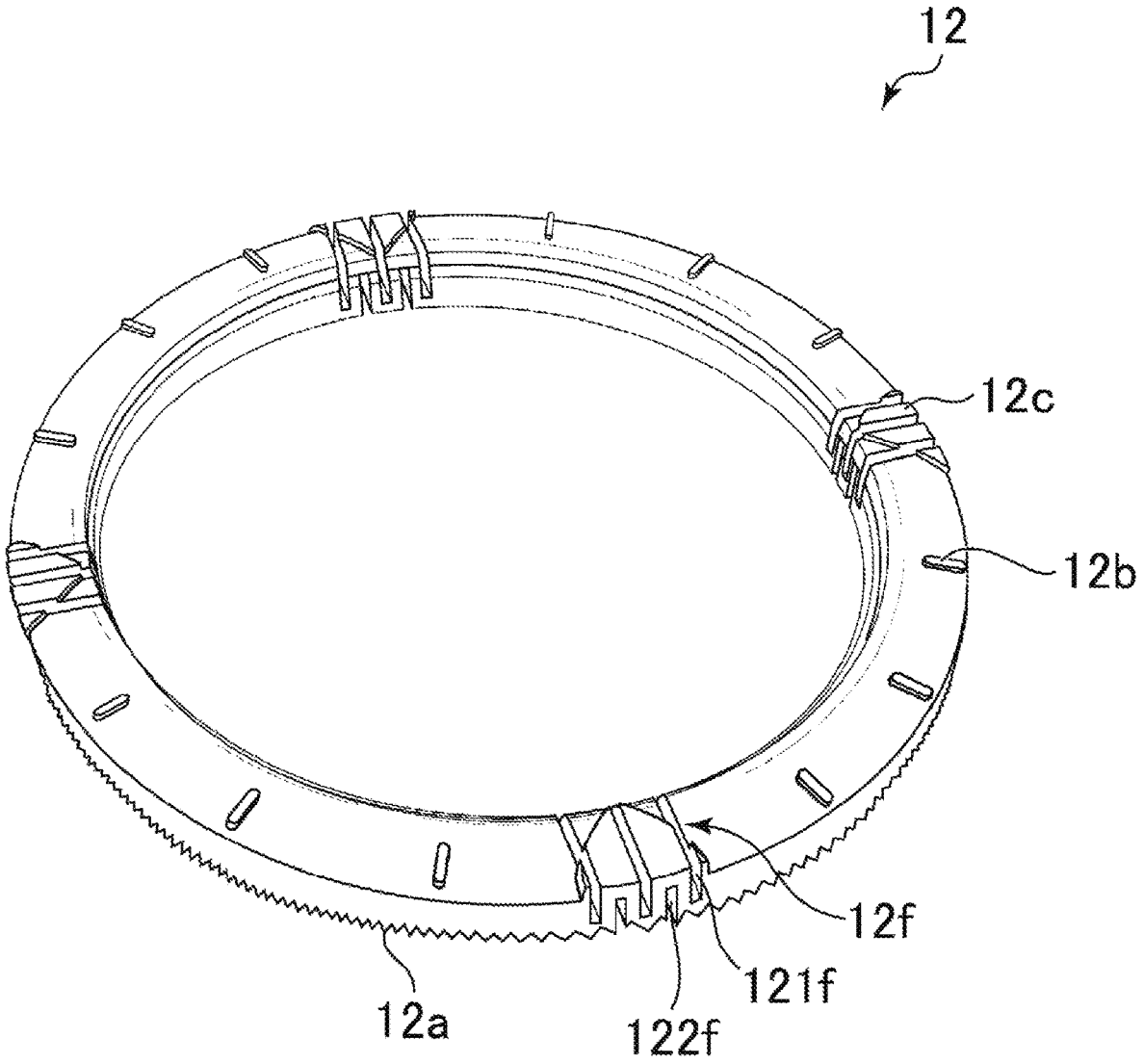
FIG. 13 is a perspective view illustrating a configuration of a ring included in a plate for a snowboard binding according to a seventh modification of the first embodiment.

A seventh modification of the first embodiment will be described with reference to FIG. 13. In the seventh modification, slits 12*f* are formed in the ring 12. Each slit 12*f* is formed from a plurality of slits 121*f*, which are formed so as to span the upper surface and side surfaces of the ring 12, and slits 122*f*, which are formed so as to span a lower surface and the side surfaces of the ring 12, the slits 121*f* and 122*f* being disposed parallelly in alternating fashion. The slits 121*f* are formed so as to be present on the protrusions 12*c* as well and the slits 122*f* are formed so as to be present on the teeth 12*a* as well. The slits 12*f* are provided in four locations in the circumferential direction of the ring 12 by being separated from one another at equal intervals. The longitudinal direction of each silt 12*f* coincides with the longitudinal direction (X direction) or the width direction (Y direction) of the snowboard 3. The slits 12*f* enhance the flexibility of the ring 12; accordingly, the slits 12*f* enhance, in particular, the flexibility of the binding 2 directly under the same, and meshing between the teeth 12*a* of the ring 12 and the teeth 21*a* of the binding 2 can be maintained to be even more favorable.

Second Embodiment

Figure 14A:
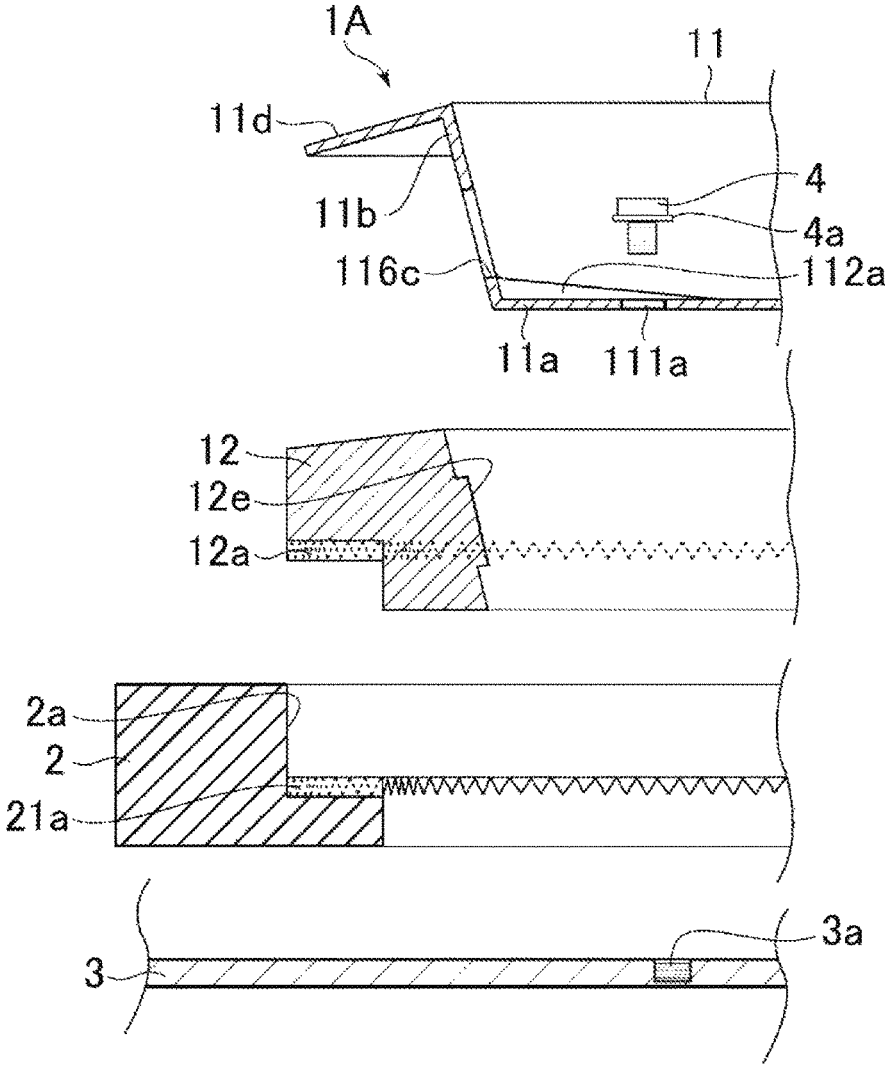
FIG. 14(A) is an explanatory schematic and partially cross-sectional diagram, illustrating a state before the binding is attached to the snowboard using a plate for a snowboard binding according to a second embodiment.

A plate for a snowboard binding according to a second embodiment will be described with reference to FIG. 14. In the second embodiment, constituents equivalent to those of the plate for a snowboard binding according to the first embodiment are assigned the same reference numerals as in the first embodiment and, while description thereof is omitted, features differing from the first embodiment will be mainly described.

A plate 1A of the second embodiment includes a flat flange 11*d* which is formed so as to be inclined downward toward the outer side in the radial direction of the plate 1A. The plate 1A is provided with the slits 116*c* formed in the side face 11*b* of the plate body 11 and the protrusions 12*e* that are formed on the inner surface of the ring 12 and fit to the slits 116*c*, as in the sixth modification. The upper surface of the ring 12 is formed in inclined fashion, and an inclination angle thereof is smaller than an inclination angle of the flange 11*d*.

Figure 14B:
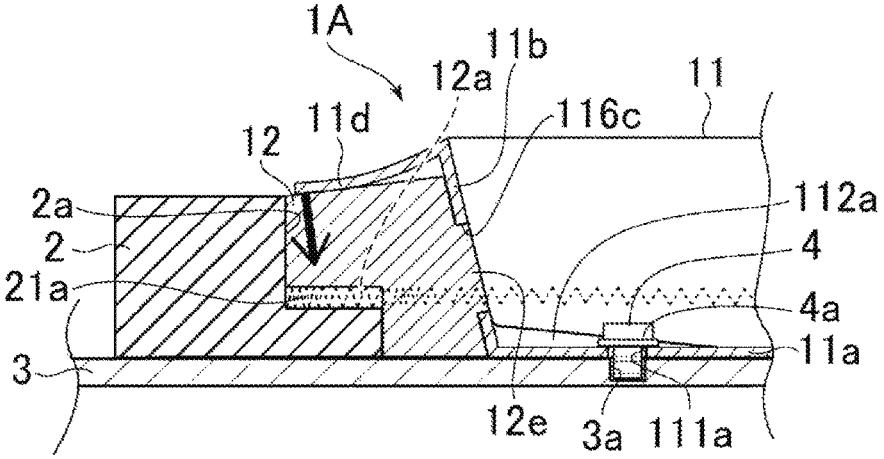
FIG. 14(B) is an explanatory schematic and partially cross-sectional diagram, illustrating a state after the binding has been attached to the snowboard using the plate for a snowboard binding according to the second embodiment.

In the present embodiment, the flange 11*d* is formed so as to be inclined downward at a larger inclination angle than the inclination angle of the upper surface of the ring 12, so when the binding 2 is attached to the snowboard 3 by using the plate 1A and fastening the screws 4, then as illustrated in FIG. 14(B), force is exerted such that, by a portion near the outer circumferential edge of the flange 11*d*, the site at which the teeth 12*a* of the plate 1A and the teeth 21*a* of the binding 2 mesh is pressed obliquely downward and toward the inner side in the radial direction of the plate 1A. Thus, by virtue of the flange 11*d*, force that presses the site at which the teeth 12*a* of the plate 1A and the teeth 21*a* of the binding 2 mesh (which are inclined during a glide) is exerted more easily, and deterioration in the meshing of the same can be prevented.

Third Embodiment

Figure 15A:
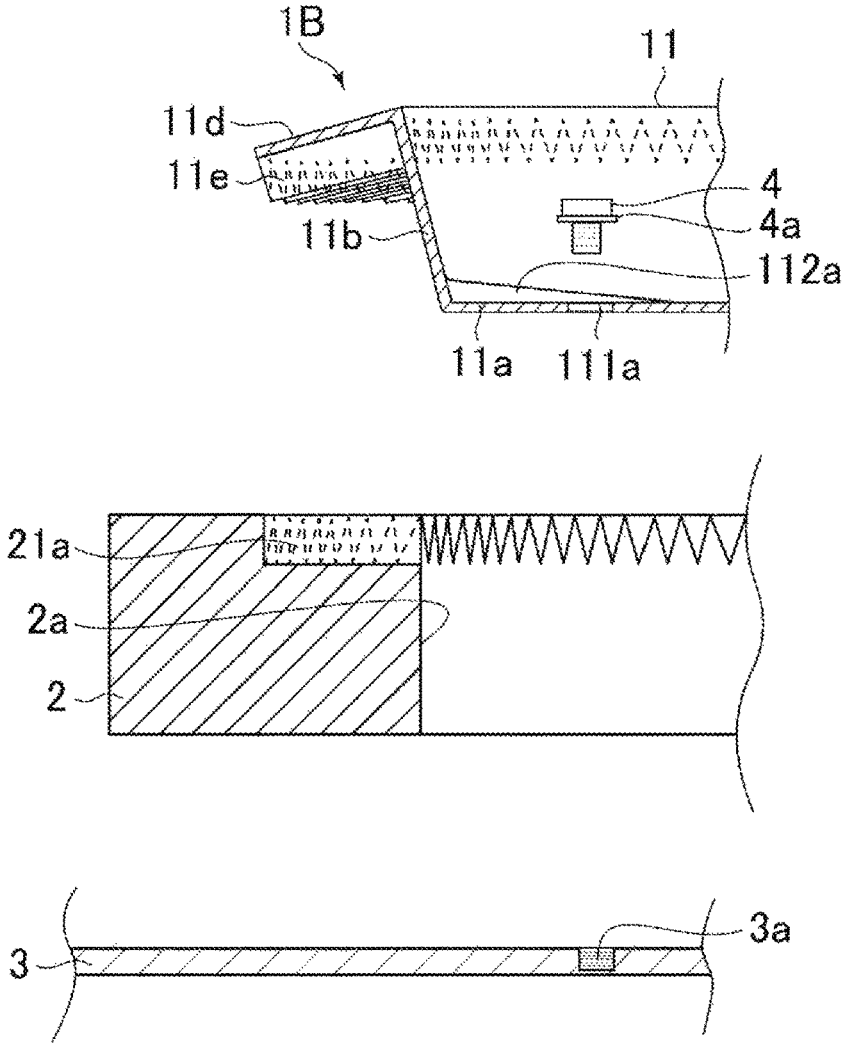
FIG. 15(A) is an explanatory schematic and partially cross-sectional diagram, illustrating a state before the binding is attached to the snowboard using a plate for a snowboard binding according to a third embodiment.

A plate for a snowboard binding according to a third embodiment will be described with reference to FIG. 15. In the third embodiment, constituents equivalent to those of the plate for a snowboard binding according to the first or second embodiment are assigned the same reference numerals as in the first or second embodiment and, while description thereof is omitted, features differing from the first embodiment will be mainly described.

In the third embodiment, a plate 1B does not include the ring 12, and a serrated teeth 11*e* is formed on the lower surface of the flange 11*d* integrally therewith, the teeth 11*e* being continuous in the circumferential direction. The teeth 21*a* are formed above the opening 2*a* of the binding 2.

Figure 15B:
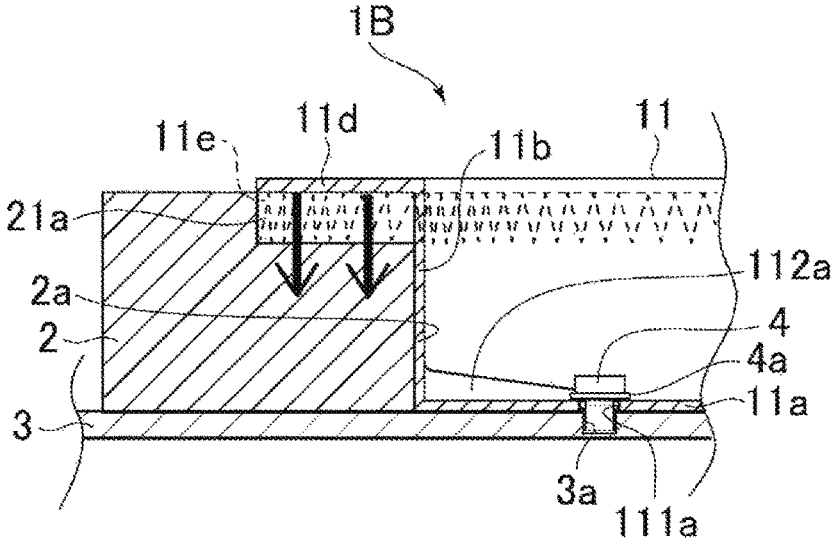
FIG. 15(B) is an explanatory schematic and partially cross-sectional diagram, illustrating a state after the binding has been attached to the snowboard using the plate for a snowboard binding according to the third embodiment.

When the plate 1B having the side face 11*b* inclined upward toward the outer side in the radial direction is secured to the snowboard 3 by being fastened using the screws 4, then as illustrated in FIG. 15(B), the plate 1B is accommodated in the opening 2*a* of the binding 2 having an inner circumferential surface that is roughly perpendicular to the snowboard 3. Restoration force for restoring the original shape acts on the side face 11*b* of the plate 1B, and accordingly, force that presses the teeth 11*e* against the teeth 21*a* of the binding 2 acts on the flange 11*d* that is formed contiguously with the side face 11*b*. Thus, in the present embodiment, favorable meshing between the teeth 11*e* of the plate 1B and the teeth 21*a* of the binding 2 can be maintained.

Note that even when the inner circumferential surface of the opening 2*a* of the binding 2 is inclined upward toward the outer side in the radial direction of the opening 2*a*, if the inclination angle thereof is smaller than the inclination angle of the side face 11*b* of the plate 1B, then accommodation of the plate 1B in the opening 2*a* of the binding 2 results in restoration force for restoring the original shape acting on the side face 11*b* and the flange 11*d*. Thus, a beneficial effect is achieved in that meshing between the teeth 11*e* of the plate 1B and the teeth 21*a* of the binding 2 is maintained to be favorable.

Fourth Embodiment

Figure 16A:
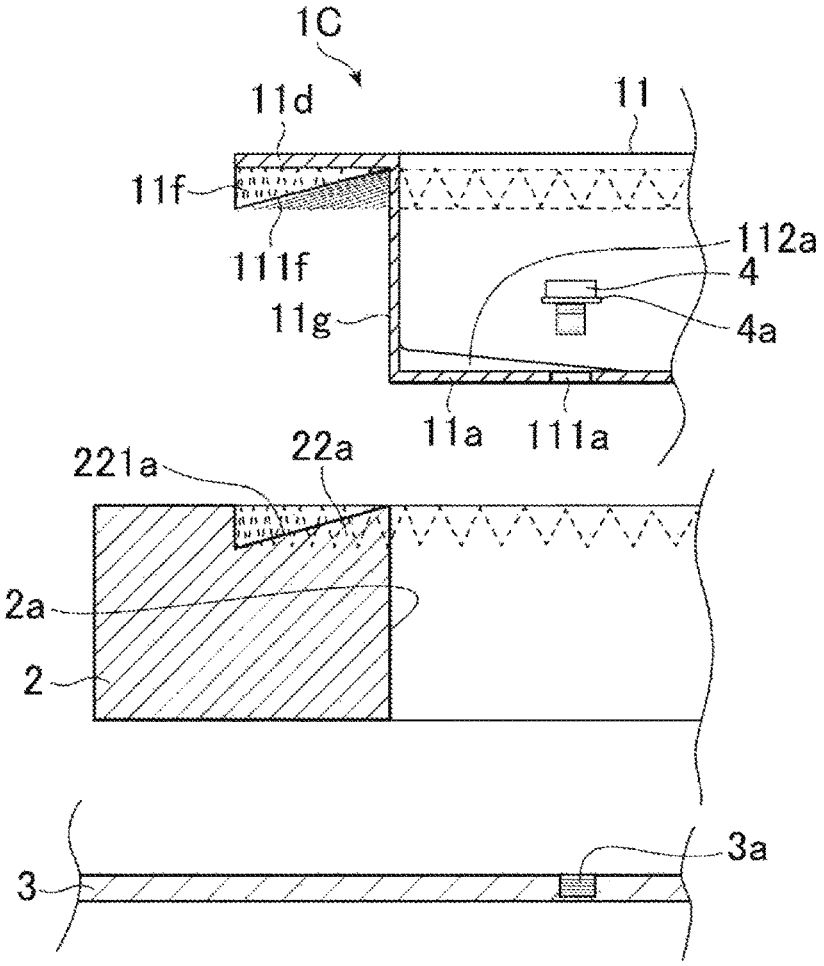
FIG. 16(A) is an explanatory schematic and partially cross-sectional diagram, illustrating a state before the binding is attached to the snowboard using a plate for a snowboard binding according to a fourth embodiment.

A plate for a snowboard binding according to a fourth embodiment will be described with reference to FIGS. 16 and 17. In the fourth embodiment, constituents equivalent to those of the plate for a snowboard binding according to the first or second embodiment are assigned the same reference numerals as in the first or second embodiment and features differing from the third embodiment will be mainly described. In the fourth embodiment, inclined surfaces 111*f* are formed on mountain parts of the serrated teeth 11*f* that is formed on the lower surface of the flange 11*d* of a plate 1C integrally therewith, the teeth 11*f* being continuous in the circumferential direction. The inclined surfaces 111*f* are inclined upward toward the inner side in the radial direction of the plate 1C from the lower vertex of an outermost surface of the teeth 11*f* to an uppermost end of the teeth 11*f* on a base side thereof.

Inclined surfaces 221*a*, which abut against the inclined surfaces 111*f* of the teeth 11*f* of the plate 1C, are formed in valley parts of the serrated teeth 22*a* of the binding 2. The inclined surfaces 221*a* are inclined downward toward the outer side in the radial direction of the opening 2*a* from an uppermost end of an innermost surface of the teeth 22*a* to a lowermost portion of the teeth 22*a* on the outermost side thereof. A side face 11*g* of the plate 1C is formed so as to be roughly perpendicular to the bottom 11*a*.

Figure 16B:
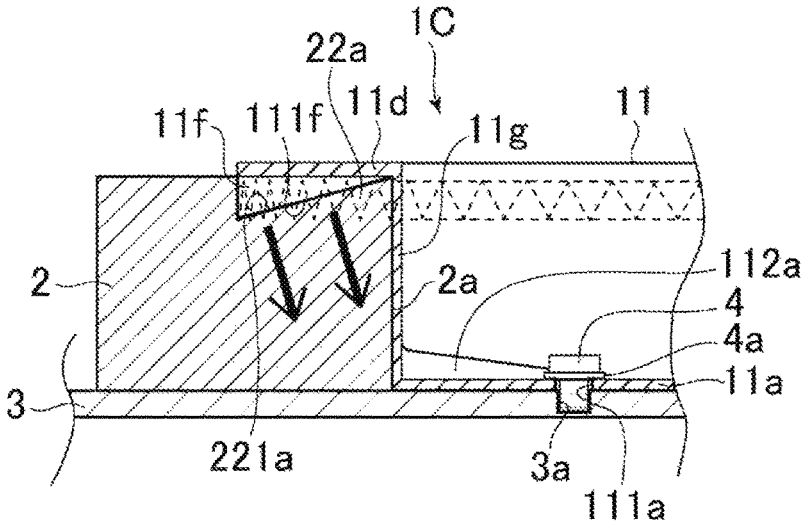
FIG. 16(B) is an explanatory schematic and partially cross-sectional diagram, illustrating a state after the binding has been attached to the snowboard using the plate for a snowboard binding according to the fourth embodiment.
Figure 17:
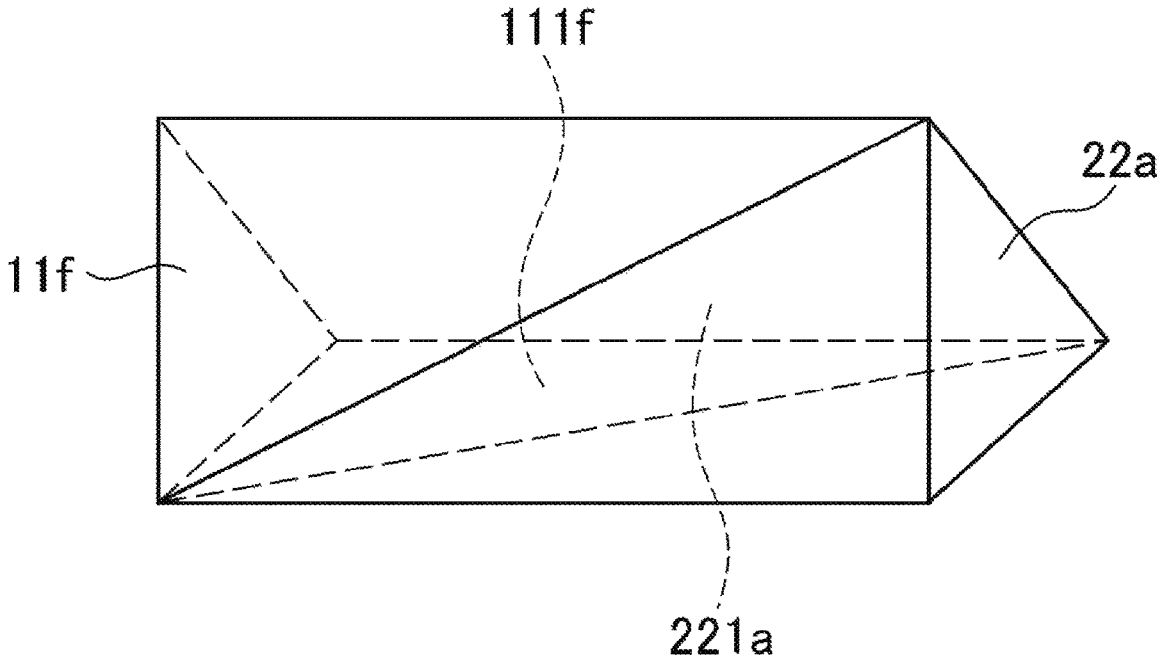
FIG. 17 is a partial schematic perspective view, illustrating a state where an inclined surface included in teeth of the plate for a snowboard binding according to the fourth embodiment is in abutment against an inclined surface of teeth of the binding.

When the binding 2 is attached to the snowboard 3 by using the plate 1C and fastening the screws 4, then as illustrated in FIG. 16(B), the inclined surfaces 111*f* of the mountain parts of the teeth 11*f* of the plate 1C abut against the inclined surfaces 221*a* of the valley parts of the teeth 22*a* of the binding 2, and force is exerted such that the teeth 11*f* of the plate 1C presses the teeth 22*a* of the binding 2 obliquely downward and toward the inner side in the radial direction of the plate 1C. Thus, in the present embodiment, favorable meshing between the teeth 11*f* of the plate 1C and the teeth 22*a* of the binding 2 (which are inclined during a glide) can be maintained.

Hereabove, the present invention has been described through exemplification of embodiments, but the present invention is not limited to the embodiments above, and various modifications other than the modifications described above are possible. For example, the description of the embodiments above illustrates various types of ribs 112*a*, 113*a*, 114*a*, and 115*a*, silts 111*c*, 114*c*, 115*c*, 116*c*, and 12*f*, a rhombic hole 113*c*, a circular hole 117*c*, and so forth, but the disposition, direction, shape, number, combination, etc. of the ribs, slits, holes, and so on can be changed, as appropriate, in accordance with, for example, basic turns and tricks as well as, for example, the purpose of gliding with the snowboard 3, e.g. a speed competition. In particular, balance in disposition, combination, and so on, of slits and holes, which enhance the flexibility of the plate, and ribs, which harden the plate only in desired directions, is to be taken into consideration.

Disposition of a slit or a hole on an inner side from the screw insertion through holes 111*a* in the radial direction of the plate results mainly in an enhancement of the flexibility of the snowboard 3 directly thereunder and disposition of a slit on an outer side from the screw insertion through hole 111*a* in the radial direction of the plate results mainly in an enhancement of the flexibility of the binding 2 near the slit; in view of this, the flexibility of each of the snowboard 3 and the binding 2 can be adjusted, as appropriate.

The embodiments above describe examples in which the plate includes slits, but even without such slits being provided, flexibility can be adequately enhanced by forming the plate into a thin plate. Further, the embodiments above describe examples in which the plate includes ribs, but in cases where, for example, it is not particularly intended to efficiently transmit force to the binding 2 and the snowboard 3 via the plate in a desired direction, there is no need to provide any ribs.

The embodiments above describe examples in which washers 4*a* are employed, but if, for example, the diameters of the heads of the screws 4 are made larger than the width of the screw insertion through holes 111*a*, it is possible not to employ any washers 4*a*. If no washers 4*a* are employed, flexibility of the plate can be further enhanced.

The embodiments above describe examples in which screw insertion through holes 111*a* having a circular arc shape are formed in the plate, but the screw insertion through hole 111*a* may be formed to be linear. If the screw insertion through holes 111*a* are linear, it is possible to, for example, adjust the position of the binding 2 in the longitudinal direction (X direction) or the width direction (Y direction) of the snowboard 3 when attaching the binding 2 to the snowboard 3. Further, although examples have been described in which four screw insertion through holes 111*a* are formed in the plate, the number of screw insertion through holes 111*a* is not limited to four and, for example, three or two screw insertion through holes 111*a* may be formed. A reduction in the number of screw insertion through holes 111*a* results in a reduction in the number of screws 4 so that flexibility of the plate can be enhanced.

The third embodiment above describes an example in which the side face 11*b* of the plate 1B is inclined upward toward the outer side in the radial direction, but the side face 11*b* may be formed to be perpendicular to the bottom 11*a*, rather than being inclined. Even if the side face 11*b* is not inclined, flexibility of the plate 1B is enhanced as a result of the plate 1B being formed from a thin plate, so deterioration in the meshing of the teeth 11*e* of the plate 1B and the teeth 21*a* of the binding 2 can be adequately prevented.

The teeth 12*a* and 11*e* of the plate in the first to third embodiments may be replaced with the teeth 11*f* of the fourth embodiment where the mountain parts include the inclined surfaces 111*f* and the teeth 21*a* of the binding 2 in the first to third embodiments may be replaced with the teeth 22*a* of the fourth embodiment where the valley parts include the inclined surfaces 221*a*, so that meshing between the teeth of the plate and the teeth of the binding are maintained to be even more favorable.

Moreover, even when the teeth of the plate is inclined upward toward the outer side in the radial direction and the teeth of the binding 2 is inclined upward toward the outer side in the radial direction of the opening 2*a* in the first to third embodiments, the present invention is applicable.

The first embodiment above describes an example in which, for example, a total of eight ribs 112*a* are provided in pairs that are disposed in four locations by being separated from one another at equal intervals in the circumferential direction of the bottom 11*a* of the plate 1, but the ribs 112*a* may be formed on the bottom 11*a* of the plate 1 in radial fashion. If the ribs 112*a* are formed in radial fashion, it is easier for the snowboarder to transmit force equally in all directions of the snowboard 3 and, for example, beneficial effects are achieved in terms of a response to turns, or the like, being improved and the gliding speed being increased.

The seventh modification of the first embodiment above describes an example in which the slits 12*f* are provided in four locations in the circumferential direction of the ring 12 by being separated at equal intervals, but, for example, the slits 12*f* may be formed in radial fashion in the ring 12 at locations where the small protrusions 12*b* are formed. Moreover, as described above, the disposition, direction, shape, number, combination, etc. of the slits 12*f* can be changed, as appropriate.

The first modification of the first embodiment above describes an example in which a rhombic hole 113*c* is formed at the site where the ribs 113*a* intersect each other in an X-shape, but it is also possible to enhance the effect demonstrated by the ribs 113*a* by not forming the rhombic hole 113*c*.

The second embodiment above describes an example in which the upper surface of the ring 12 is formed so as to be inclined, but the upper surface of the ring 12 may also not be inclined.

The embodiments above describe examples in which hexagon socket set screws 4 are employed, but, for example, cross-recess head screws, slotted head screws, square head screws, or other such screws may be employed instead.

DESCRIPTION OF REFERENCE NUMERALS AND SYMBOLS

1, 1A, 1B, 1C: plate for snowboard binding (plate)
11: plate body
11*a*: bottom
111*a*: screw insertion through hole
112*a*, 113*a*, 114*a*, 115*a*: rib
113*c*: rhombic hole
11*b*, 11*g*: side face
11*c*, 11*d*: flange
111*c*, 114*c*, 115*c*, 116*c*, 12*f*: slit
117*c*: circular hole
12: ring
12*a*, 11*e*, 11*f*: teeth
111*f*: inclined surface
12*c*, 12*d*, 12*e*: protrusion
2: binding
2*a*: opening
21*a*, 22: teeth
221*a*: inclined surface
3: snowboard
4: screw

The invention claimed is:

1. A plate for a snowboard binding, the plate being accommodated in an opening formed in a bottom of the binding and having teeth on a circumferential edge of the opening, the plate serving to press the binding against the snowboard and attach the binding to the snowboard by being secured to the snowboard by means of a screw, the plate characterized by comprising:

a bottom having a circular shape, an insertion through hole through which the screw is inserted being formed in the bottom; a side face provided on a circumferential edge of the bottom; a flange provided on an upper edge of the side face and protruding outward in a radial direction; and teeth provided on a lower side of the flange and configured to mesh with the teeth of the binding, the plate includes a ring, an upper surface of the ring being configured to be attached to a lower surface of the flange, the teeth of the plate for a snowboard binding being formed on a lower surface of the ring, and an outer circumferential edge of the flange is formed in the shape of a curved surface protruding toward an outer side in the radial direction and obliquely upward.

2. The plate for a snowboard binding according to claim 1, characterized in that the plate includes a ring attached to the lower side of the flange, the teeth of the plate for a snowboard binding being formed on a lower surface of the ring, and the flange is inclined downward toward an outer side in the radial direction.

3. The plate for a snowboard binding according to claim 1, characterized in that the teeth of the plate for a snowboard binding are formed on a lower surface of the flange.

4. The plate for a snowboard binding according to claim 1, characterized in that the side face is inclined upward toward an outer side in the radial direction, and an inner circumferential surface of the opening of the binding is perpendicular to the snowboard.

5. The plate for a snowboard binding according to claim 1, characterized in that the side face is inclined upward toward an outer side in the radial direction, and an inner circumferential surface of the opening of the binding is inclined upward toward the outer side in the radial direction of the opening, and an inclination angle of the inner circumferential surface is smaller than an inclination angle of the side face.

6. The plate for a snowboard binding according to claim 1, characterized in that each mountain part of the teeth of the plate for a snowboard binding includes an inclined surface inclined upward toward an inner side from a lower vertex of a radially outermost surface of the teeth to an uppermost end of the teeth on a base side, and each valley part of the teeth of the binding includes an inclined surface configured to abut against the inclined surface of the mountain part of the teeth of the plate for a snowboard binding and being inclined downward toward an outer side from an uppermost end of an innermost surface of the teeth in the radial direction of the opening to a lowermost portion of the teeth on an outermost side in the radial direction of the opening.

7. The plate for a snowboard binding according to claim 1, characterized in that the plate includes a hole formed in a center of the bottom.

8. The plate for a snowboard binding according to claim 1, characterized in that the plate includes a plurality of ribs formed on the bottom from a circumferential edge side toward a center of the bottom.

9. The plate for a snowboard binding according to claim 8, characterized in that the ribs are provided in radial fashion.

10. The plate for a snowboard binding according to claim 1, characterized in that the plate includes ribs formed on the bottom in a form of intersecting each other in an X-shape.

11. The plate for a snowboard binding according to claim 10, characterized in that a hole is formed at a portion where the ribs intersect each other in an X-shape.

12. The plate for a snowboard binding according to claim 1, characterized in that the plate includes a rib formed on the bottom, a longitudinal direction of the rib coinciding with a longitudinal direction of the snowboard.

13. The plate for a snowboard binding according to claim 1, characterized in that the plate includes a rib formed on the bottom, a longitudinal direction of the rib coinciding with a width direction of the snowboard.

14. The plate for a snowboard binding according to claim 1, characterized in that the bottom, the side face, and the flange are formed from a thin plate.

15. The plate for a snowboard binding according to claim 1, characterized in that a material of the bottom, the side face, and the flange is pure titanium, titanium alloy, stainless steel, or maraging steel.

16. The plate for a snowboard binding according to claim 15, characterized in that a material of the teeth of the plate for a snowboard binding is pure titanium, titanium alloy, stainless steel, or maraging steel.

17. A plate for a snowboard binding, the plate being accommodated in an opening formed in a bottom of the binding and having teeth on a circumferential edge of the opening, the plate serving to press the binding against the snowboard and attach the binding to the snowboard by being secured to the snowboard by means of a screw, comprising:

a bottom having a circular shape, an insertion through hole through which the screw is inserted being formed in the bottom;

a side face provided on a circumferential edge of the bottom;

a flange provided on an upper edge of the side face and protruding outward in a radial direction; and teeth provided on a lower side of the flange and configured to mesh with the teeth of the binding, wherein the plate further includes slits formed in the flange by partially cutting off an outer circumferential edge of the flange.

18. The plate for a snowboard binding according to claim 1, characterized in that the plate includes slits formed in the ring.

19. The plate for a snowboard binding according to claim 17, characterized in that the slits are arranged in a circumferential direction such that each two of the slits, which are adjacent, are separated with a predetermined interval, the plate includes a ring having protrusions formed on an upper surface of the ring, the protrusions being arranged in the circumferential direction such that each two of the protrusions, which are adjacent, are separated with a predetermined interval, each of the protrusions is placed to correspond to one of the slits to mate such that the ring is attached to a lower surface of the flange by mating the protrusions with the slits.

20. The plate for a snowboard binding according to claim 17, characterized in that a longitudinal direction of the slits coincides with a longitudinal direction of the snowboard.

21. The plate for a snowboard binding according to claim 17, characterized in that a longitudinal direction of the slits coincides with a width direction of the snowboard.

* * * * *